US006988919B2

(12) United States Patent
Tanaka et al.

(10) Patent No.: US 6,988,919 B2
(45) Date of Patent: Jan. 24, 2006

(54) OIL COOLER AND SMALL WATERCRAFT

(75) Inventors: Yoshinobu Tanaka, Hyogo (JP); Atsufumi Ozaki, Kobe (JP); Yoshimoto Matsuda, Kobe (JP); Yasuo Okada, Akashi (JP); Hideaki Ebisui, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/696,164

(22) Filed: Oct. 28, 2003

(65) Prior Publication Data

US 2004/0132359 A1 Jul. 8, 2004

(30) Foreign Application Priority Data

Oct. 29, 2002 (JP) ..... 2002-314348
May 12, 2003 (JP) ..... 2003-132998
Oct. 27, 2003 (JP) ..... 2003-365848

(51) Int. Cl.
*B63H 21/10* (2006.01)

(52) U.S. Cl. ..... 440/88 HE; 440/88 C

(58) Field of Classification Search ..... 440/38, 440/88 C, 88 D, 88 HE; 165/168; 123/196 AB
See application file for complete search history.

(56) References Cited

U.S. PATENT DOCUMENTS 2,691,972 A * 10/1954 Stump et al. ..... 123/196 AB
3,830,289 A * 8/1974 Olson ..... 165/51
5,199,395 A * 4/1993 Mizumura et al. .... 123/196 AB
5,477,817 A * 12/1995 Hufendiek et al. ..... 123/41.33
6,530,425 B2 * 3/2003 Wehrmann et al. ..... 165/167
6,712,652 B2 * 3/2004 Roycroft ..... 440/12.51

FOREIGN PATENT DOCUMENTS

JP 11-082022 3/1999

* cited by examiner

*Primary Examiner*—Ed Swinehart

(74) *Attorney, Agent, or Firm*—Alleman Hall McCoy Russell & Tuttle LLP

(57) ABSTRACT

An oil cooler of an engine for small watercraft. The oil cooler typically includes a mounting portion configured to mount the oil cooler on an outer wall face of an engine of the small watercraft, an oil passage configured to allow oil to flow therethrough and lead to outside of the oil cooler at the mounting portion, and a coolant passage through which coolant for cooling the oil flows, wherein the oil cooler is capable of being disassembled such that an inside of at least the coolant passage is exposed.

18 Claims, 23 Drawing Sheets

OIL COOLER AND SMALL WATERCRAFT

BACKGROUND OF THE INVENTION

1. Field of the Invention

The present invention relates to an oil cooler configured to cool oil that circulates within an engine, and a small watercraft comprising the oil cooler.

2. Description of the Related Art

In recent years, jet-propulsion personal watercraft, which are one type of small watercraft, have been widely used in leisure, sport, rescue activities, and the like. The personal watercraft is equipped with an engine within a space surrounded by a hull and a deck. The personal watercraft is configured to have a water jet pump that pressurizes and accelerates water sucked from a water intake generally provided on a hull bottom surface and ejects it rearward from an outlet port. As the resulting reaction, the personal watercraft is propelled forward.

Oil circulates within the engine mounted in the personal watercraft to lubricate and cool various components within the engine. In order for the oil to fully function, the oil is required to have a proper temperature. However, the oil that has circulated within the engine has a relatively high temperature, and therefore, an oil cooler is used to cool the oil (see Japanese Issued Patent No. 3276593, FIG. 2). In some cases, conventional oil coolers are positioned distant from the engine (mainly comprised of a crankcase, a cylinder block, and a cylinder head), for example, in the vicinity of an oil tank provided to be independent of the engine.

A number of pipes, for example, a pipe that draws the oil into the oil cooler, a pipe that draws the oil out of the oil cooler, a pipe that draws a coolant to the oil cooler, and a pipe that discharges the coolant from the oil cooler, are connected to the oil cooler. For maintenance of the oil cooler, it is necessary to attach and detach these pipes to and from the oil cooler, which is burdensome. In addition, these pipes may have a complex piping configuration. Since the piping configuration is complex and the oil cooler is positioned distant from the engine, the lengths of the pipes are extended, which makes it difficult to achieve a lightweight small watercraft.

Another prior oil cooler is made of steel plate and mounts directly on an outer wall face of a crankcase. However, such an oil cooler has difficulty in removing unwanted substances from a coolant passage, and hence is not suitable for use in an engine having an open-looped cooling system in which water is drawn from outside for use as cooling water.

SUMMARY OF THE INVENTION

The present invention addresses the above described conditions, and an object of the present invention is to provide an oil cooler that has a simple piping configuration, is easy to maintain, and achieves a lightweight small watercraft, as well as a small watercraft comprising the oil cooler.

According to the present invention, there is provided an oil cooler of an engine for small watercraft, comprising a mounting portion configured to mount the oil cooler on an outer wall face of the engine, an oil passage configured to allow oil to flow therethrough and lead to outside of the oil cooler at the mounting portion, and a coolant passage through which coolant for cooling the oil flows, wherein the oil cooler is capable of being disassembled such that an inside of at least the coolant passage is exposed.

In accordance with the above construction, by directly mounting the oil cooler on the wall face of the engine, an oil gallery formed within the engine can communicate with the oil passage of the oil cooler without a tube or the like. Therefore, the number of pipes around the oil cooler can be reduced and piping configuration is simplified. In addition, since the oil cooler is disassembled to allow an inside of at least the coolant passage to be exposed, maintenance of the oil cooler, for example, removal of unwanted substances from the coolant passage can be carried out.

The oil cooler may include a passage forming plate provided with grooves on one face thereof and an opposite face thereof, and first and second cover members configured to cover the grooves, respectively, the oil passage may be formed by covering the groove formed on the one face of the passage forming plate with the first cover member, the coolant passage may be formed by covering the groove formed on the opposite face of the passage forming plate with the second cover member, and the second cover member may be at least partially removably attachable to allow the inside of the coolant passage to be exposed.

In accordance with the above construction, by removing the first or second cover member from the passage forming plate, an inside of the oil passage or the coolant passage is easily exposed. Alternatively, the cover member may be removably attachable only at a portion of the coolant passage that tends to be clogged with unwanted substances. As another alternative, the cover member may be formed integrally with the passage forming plates at portions of the oil passage and the coolant passage that need not be exposed.

The first cover member may be provided with a sensor-attaching portion configured to attach a hydraulic-pressure sensor and/or an oil-temperature sensor. The sensor-attaching portion allows the hydraulic-pressure sensor and the oil-temperature sensor to be easily attached, and hence maintenance of these sensors can be easily carried out.

The oil cooler may further comprise an oil filter attaching and detaching portion configured to removably attach an oil filter of the engine on the first cover member, wherein an oil hole may be formed in the first cover member in the vicinity of the oil filter attaching and detaching portion to allow the oil filter and the oil passage to communicate with each other with the oil filter attached on the first cover member. With this configuration, the engine provided with the oil cooler becomes compact.

An oil-receiving portion may be provided on the first cover member in the vicinity of the oil filter attaching and detaching portion and below the attached oil filter. Since the oil-receiving portion can receive the oil that leaks out when the oil filter is removed for a built-in filter element to be changed, the element is changed efficiently. The oil-receiving portion may be formed integrally with or independently of the first cover member.

The oil-receiving portion may be plate shaped and may be configured to extend from the first cover member along a center axis of the oil filter.

The cooler may further comprise an adapter configured to allow the oil passage of the oil cooler to communicate with another oil cooler, wherein the adapter may be provided between the oil filter and the first cover member. The adapter may be removably attached on the first cover member by means of a tubular mounting bolt of the oil cooler. In accordance with the above configuration, another oil cooler may be connected to the oil cooler of the present invention through the adapter as necessary in order to gain desired oil cooling capability in the engine. Thus, by increasing the number of oil coolers to increase cooling capacity, the design of the oil cooler itself need not be changed in order to address changes in cooling requirements of the engine.

The oil cooler of an engine for small watercraft, comprising a mounting portion configured to mount the oil cooler on an outer wall face of the engine, an oil passage configured to allow oil to flow therethrough and lead to outside of the oil cooler at the mounting portion, and a coolant passage through which coolant for cooling the oil flows, wherein the oil cooler is capable of being disassembled such that an inside of at least the coolant passage is exposed, may further comprise a plurality of passage forming plates each provided with a groove on at least one face thereof, wherein the passage forming plates may be removably disposed to have a layered structure, and the oil passage and the coolant passage may be each formed by the groove between the passage forming plates.

In accordance with the construction, by disassembling the oil cooler into the passage forming plates, the oil passage and the coolant passage are exposed, and hence are easy to maintain. By changing the number of the passage forming plates to be stacked, the cooling capability of the oil can be changed.

According to an aspect of the above-discussed oil cooler, the passage forming plates may be comprised of an oil passage forming plate forming the oil passage and a coolant passage forming plate forming the coolant passage which are alternately disposed to have a layered structure. In such a configuration, the cooling capability of the oil cooler can be easily changed by disposing stacked pairs of plates, each pair having an oil passage forming plate and coolant passage forming plate, in a suitable number.

In the oil cooler of an engine for small watercraft, comprising a mounting portion configured to mount the oil cooler on an outer wall face of the engine, an oil passage configured to allow oil to flow therethrough and lead to outside of the oil cooler at the mounting portion, and a coolant passage through which coolant for cooling the oil flows, wherein the oil cooler is capable of being disassembled such that an inside of at least the coolant passage is exposed, an inside of at least part of the coolant passage may be exposed at the mounting portion. In other words, with the oil cooler mounted on the outer wall face of the engine, at least part of the coolant passage may be formed by the outer wall face. This makes it possible to cool the wall portion of the crankcase as well as the oil. Also, when the oil gallery is formed in the wall portion, the oil following through the oil gallery can be cooled.

The oil cooler may further comprise a passage forming plate provided with a groove on at least one face thereof, and a first cover member configured to cover the groove formed on the one face of the passage forming plate, wherein the passage forming plate may be removably mounted on the outer wall face of the engine with an opposite face thereof in contact with the outer wall face of the engine, the oil passage may be formed by covering the groove formed on the one face with the first cover member, and the coolant passage may be formed between the opposite face of the passage forming plate and the outer wall face of the engine.

In such a configuration, since the opposite face of the passage forming plate on the coolant passage side is in contact with the outer wall face of the engine, the outer wall face of the engine is cooled, and when the oil gallery is formed in the wall portion of the engine, the oil flowing within the oil gallery is cooled. Further, since a cover member configured to cover the opposite face of the passage forming plate on the coolant passage side need not be provided, the number of components can be reduced and hence lightweight watercraft can be achieved.

The passage forming plate may be provided with a groove on the opposite face thereof, and the groove formed on the opposite face may be covered with the outer wall face of the engine. Such a structure increases the flow-cross-sectional area of the coolant.

A groove may be formed on the outer wall face of the crankcase that partially forms the coolant passage. In such a configuration, since the flow-cross-sectional area of the coolant passage and a contact area of the coolant with the outer wall face of the engine can be increased, the cooling capability of the oil cooler can be improved.

The oil cooler may further comprise an oil filter attaching and detaching portion configured to removably attach the oil filter of the engine on the first cover member, wherein an oil hole may be formed in the first cover member in the vicinity of the oil filter attaching and detaching portion to allow the oil filter and the oil passage to communicate with each other with the oil filter attached on the first cover member. Also, the oil cooler may further comprise an adapter configured to allow the oil passage of the oil cooler to communicate with another oil cooler, wherein the adapter may be provided between the oil filter and the first cover member on the oil passage side.

In the engine, air-intake pipes and exhaust pipes extending from a cylinder head of the engine are arranged in various configurations. In the case of personal watercraft, typically, the pipes extend from the cylinder head to the position lateral of a crankcase of the engine. In such piping configuration, there is an unused space between the air-intake pipe or the exhaust pipe and the outer wall face of the crankcase.

Accordingly, a small watercraft of the present invention comprises an engine configured to drive a propulsion mechanism, an air-intake pipe and an exhaust pipe extending from a cylinder head of the engine, and an oil cooler configured to cool oil that circulates with the engine, wherein the air-intake pipe or the exhaust pipe extends from the cylinder head to a lateral side of a crankcase of the engine to have a space between the air-intake pipe and an outer wall face of the crankcase or between the exhaust pipe and the outer wall face of the crankcase, and the oil cooler is mounted on the outer wall face within the space.

In accordance with the above construction, the unused space can be utilized for the oil cooler to be placed close to the crankcase. As a result, piping configuration is simplified and compact small watercraft is achieved.

In the small watercraft, an oil gallery may be formed within a wall portion of the crankcase of the engine to allow the oil to flow therethrough, the oil cooler may include an oil passage through which the oil flows and a coolant passage through which coolant for cooling the oil flows, the oil cooler may be mounted on the wall face of the crankcase such that the oil passage communicates with the oil gallery, and the oil cooler may be capable of being disassembled such that an inside of at least the coolant passage is exposed. In accordance with the above construction, maintenance of the oil cooler, for example, removal of unwanted substances from the coolant passage can be carried out, in addition to the above described simplified piping configuration.

The engine may employ an open-looped cooling system. Specifically, the engine mounted in the small watercraft is commonly configured to take in water from outside for use as coolant (cooling water). In the open-looped cooling system, the cooling water taken in from outside sometimes contains substances such as water borne plants. Since the oil cooler can be disassembled into the coolant passages as described above, the substances within the coolant passage can be easily removed.

The small watercraft may be a personal watercraft comprising a water jet pump driven by the engine. The small watercraft includes a jet-propulsion personal watercraft equipped with the water jet pump as a propulsion mechanism. The personal watercraft has a limited inner space, and engine components and the oil cooler are generally difficult to maintain. By applying the present invention to the personal watercraft, the piping configuration is significantly simplified and maintenance becomes much easier.

The above and further objects and features of the invention will more fully be apparent from the following detailed description with accompanying drawings.

DETAILED DESCRIPTION OF THE PREFERRED EMBODIMENTS

Figure 1:
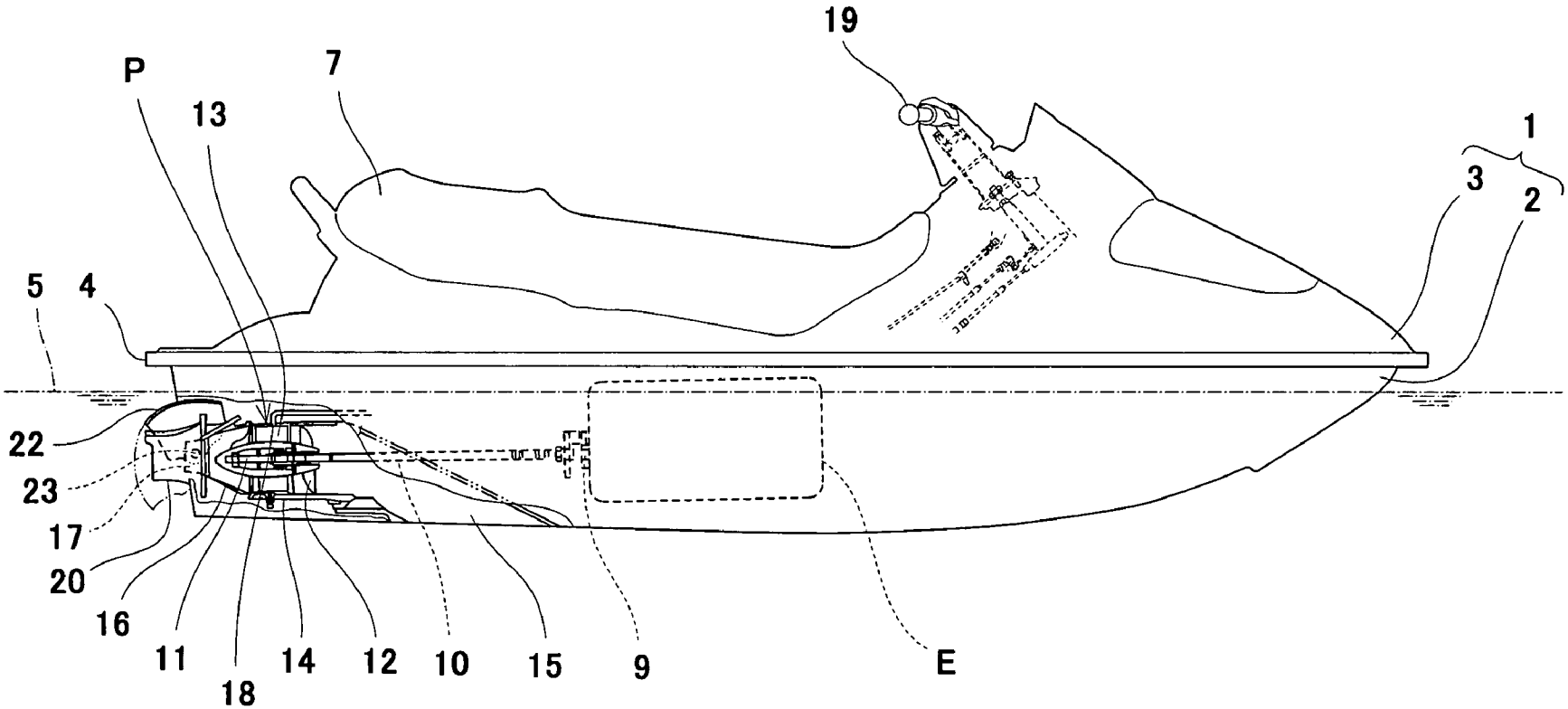
FIG. 1 is a side view of a personal watercraft according to an embodiment of the present invention.

Hereinafter, embodiments of small watercraft of the present invention will be described with reference to the accompanying drawings. Here, a personal watercraft will be described. The personal watercraft in FIG. 1 is a straddle-type personal watercraft provided with a seat 7 straddled by a rider. A body 1 of the watercraft comprises a hull 2 and a deck 3 covering the hull 2 from above. A line at which the hull 2 and the deck 3 are connected over the entire perimeter thereof is called a gunnel line 4. In FIG. 1, reference numeral 5 denotes a representative waterline on the personal watercraft.

Figure 2:
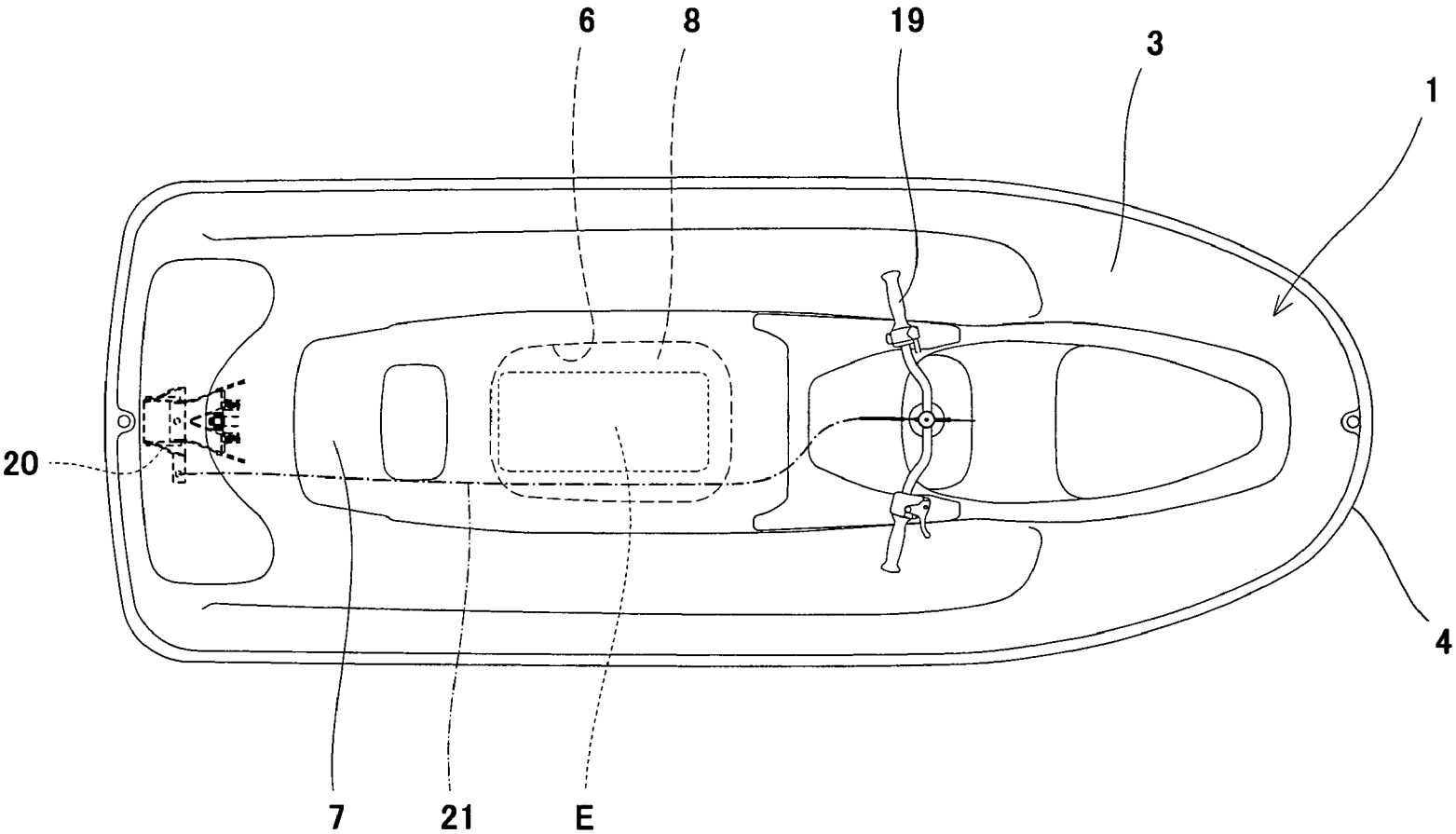
FIG. 2 is a plan view of the personal watercraft in FIG. 1.

As shown in FIG. 2, an opening 6, which has a substantially rectangular shape as seen from above, is formed at a substantially center section of the deck 3 in the upper portion of the body 1 such that its longitudinal direction corresponds with the longitudinal direction of the body 1. The seat 7 straddled by the rider is removably mounted over the opening 6.

An engine room 8 is provided in a space defined by the hull 2 and the deck 3, below the opening 6. An engine E for driving the personal watercraft is mounted within the engine room 8. The engine room 8 has a convex-shaped transverse cross-section and is configured such that its upper portion is smaller than its lower portion. In this embodiment, the engine E is an in-line four-cylinder four-cycle engine. As shown in FIG. 1, the engine E is mounted such that a crankshaft 9 extends along the longitudinal direction of the body 1.

An output end of the crankshaft 9 is rotatably coupled integrally with a pump shaft 11 of a water jet pump P provided on the rear side of the body 1 through a propeller shaft 10. An impeller 12 is attached on the pump shaft 11 of the water jet pump P. Fairing vanes 13 are provided behind the impeller 12. The impeller 12 is covered with a pump casing 14 on the outer periphery thereof.

A water intake 15 is provided on the bottom of the body 1. The water intake 15 is connected to the pump casing 14 through a water passage. The pump casing 14 is connected to a pump nozzle 16 provided on the rear side of the body 1. The pump nozzle 16 has a cross-sectional area that gradually reduces rearward, and an outlet port 17 is formed on the rear end of the pump nozzle 16.

Water outside the watercraft is sucked from the water intake 15 and fed to the water jet pump P. The water jet pump P pressurizes and accelerates the water and the fairing vanes 13 guide water flow behind the impeller 12. The water is ejected through the pump nozzle 16 and out the outlet port 17, and, as the resulting reaction, the watercraft obtains a propulsion force.

The engine E of this embodiment employs an open-looped cooling system. Specifically, as shown in FIG. 1, the pump casing 14 is provided with a water drawing hole 18, and the water pressurized by the water jet pump P is partially drawn into the watercraft through the water drawing hole 18, and is used as cooling water to cool the engine E or the like.

A bar-type steering handle 19 is provided at a front portion of the deck 3. The steering handle 19 is connected to a steering nozzle 20 provided behind the pump nozzle 16 through a cable 21 (in FIG. 2). When the rider rotates the handle 19 clockwise or counterclockwise, the steering nozzle 20 is swung toward the opposite direction so that the ejection direction of the water being ejected through the pump nozzle 16 can be changed, and the watercraft can be correspondingly turned to any desired direction while the water jet pump P is generating the propulsion force.

As shown in FIG. 1, a bowl-shaped reverse deflector 22 is provided on the rear side of the body 1 and on the steering nozzle 20 such that it can vertically swing around a horizontally mounted swinging shaft 23. The deflector 22 is swung downward to a lower position around the swinging shaft 23 to deflect the ejected water from the steering nozzle 20 forward, and as the resulting reaction, the personal watercraft moves rearward.

Embodiment 1

A first Embodiment of the present invention will be described with reference to FIGS. 3 to 7B. As shown in a side cross-sectional view in FIG. 3, the engine E mainly comprises a cylinder head 31 covered with a cylinder head cover 30 from above, a cylinder block 32 located below the cylinder head 31, and a crankcase 33 located below the cylinder block 32. Four air-intake ports 34 are provided on one side portion of the cylinder head 31 to be spaced equally apart from one other in the longitudinal direction of the engine E. The air-intake ports 34 open toward a lateral side of the engine E. One end portions 35A of air-intake pipes 35 are respectively connected to the air-intake ports 34.

Figure 3:
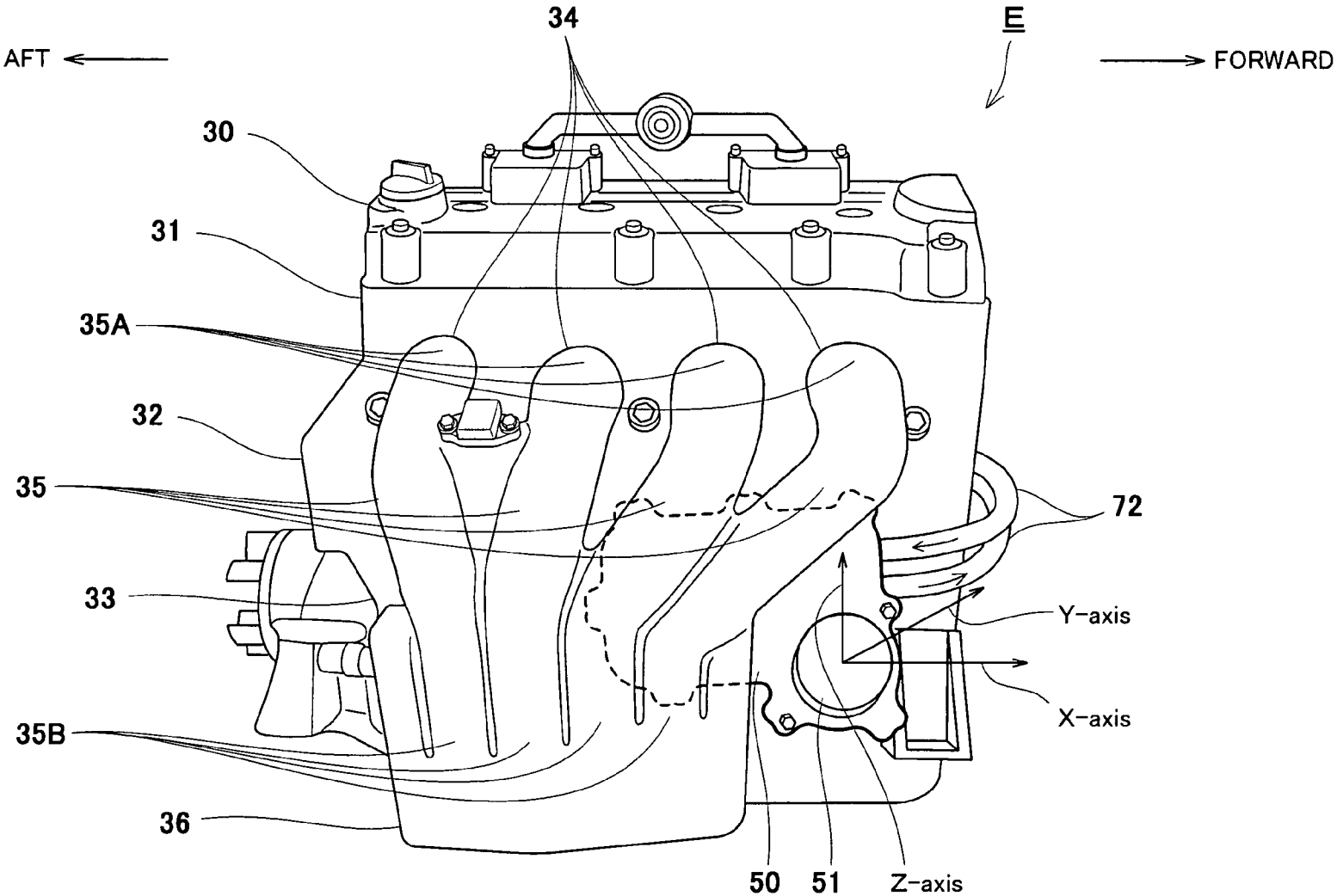
FIG. 3 is a side view of the engine mounted in the personal watercraft in FIG. 1.
Figure 4:
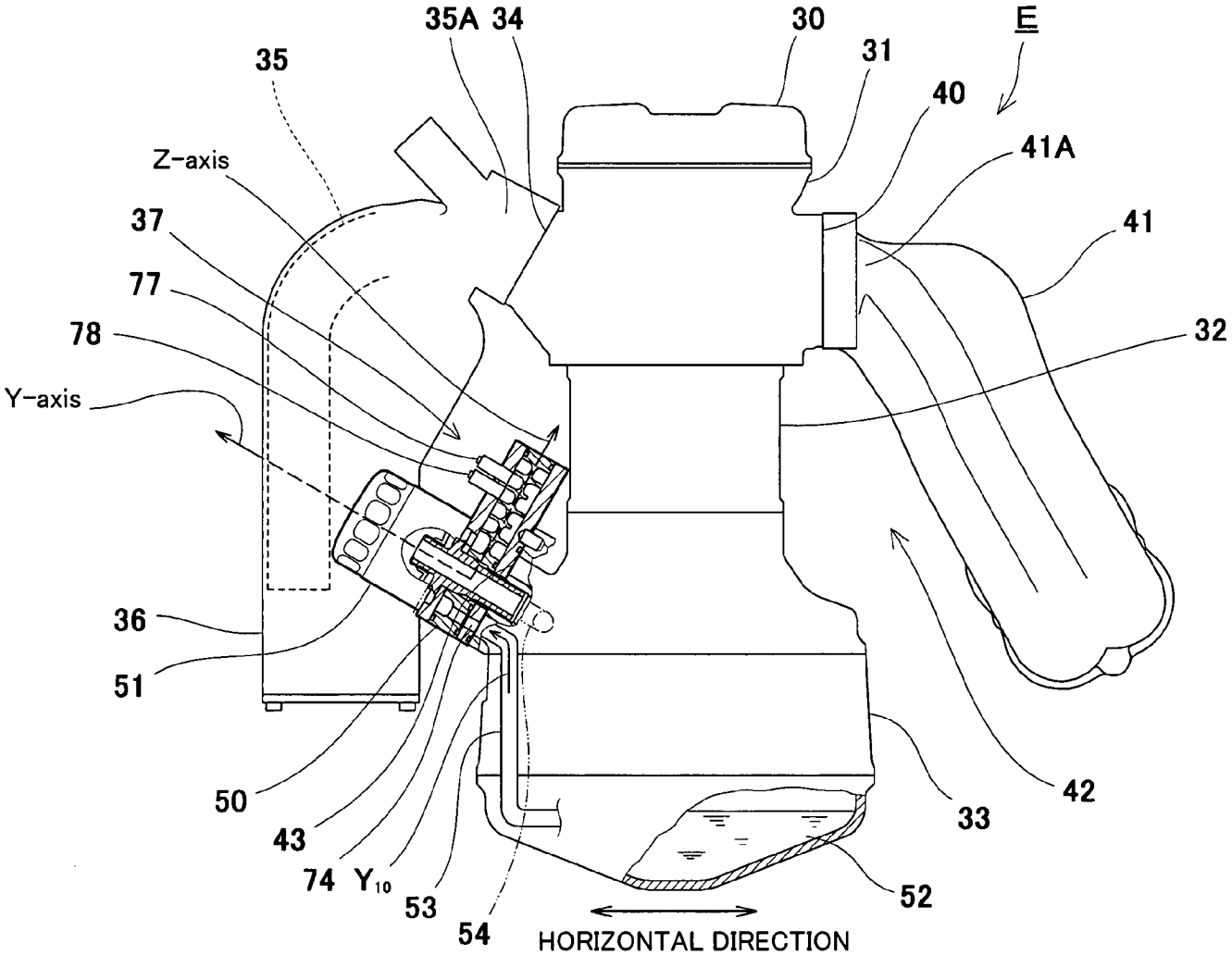
FIG. 4 is a front view of the engine in FIG. 3.

As shown in FIG. 4, each of the air-intake pipes 35 extends from the corresponding air-intake port 34 toward outer side of the engine E. Then, the air-intake pipe 35 is curved downwardly at a position thereof and then extends to a position lateral of the crankcase 33. As shown in FIG. 3, opposite end portion 35B of the air-intake pipes 35 are arranged to be closer to one another at a position slightly behind the center in the longitudinal direction of the engine E. An air-intake chamber 36 having an inner space of a predetermined volume is provided on one side of the crankcase 33. The air-intake pipes 35 are connected to an upper portion of the air-intake chamber 36 such that the opposite end portions 35B protrude into the air-intake chamber 36. The air-intake chamber 36 communicates with an air cleaner with a throttle body (not shown) provided between the air-intake chamber 36 and the air cleaner (not shown). As shown in FIG. 4, a space 37 is formed between the air-intake pipe 35 and an outer peripheral wall of the crankcase 33.

As shown in FIG. 4, four exhaust ports 40 are provided on an opposite side portion of the cylinder head 31. The exhaust ports 40 are arranged to be spaced equally apart from one another in the longitudinal direction of the engine E. The exhaust ports 40 open to the lateral side of the engine E. One end portion 41A of each of the exhaust pipes 41 is connected to a corresponding exhaust port 40. Each of the exhaust pipes 41 extends from the corresponding exhaust port 40 toward outer side of the engine E. Then, the exhaust pipe 41 is curved downwardly at a position thereof and extends to a position lateral of the crankcase 33. In addition, opposite end portions (not shown) of the exhaust pipes 41 extend rearward of the engine E from the position lateral of the crankcase 33 and are merged into one pipe connected to a muffler (not shown). In this structure, a space 42 is formed between the exhaust pipe 41 and the outer wall face of the crankcase 33.

As shown in FIG. 4, an engine-side mounting face 43 of an oil cooler 50 is formed on the outer wall portion of the crankcase 33 on an air-intake system side. The oil cooler 50 is mounted on the engine-side mounting face 43. An oil filter 51 is attached on the oil cooler 50. As shown in FIG. 3, when the engine E is seen from the air-intake system side, the oil cooler 50 placed in the space 37 is configured such that the oil filter 51 is entirely exposed. In FIG. 4, an oil tank 52 having a predetermined volume is provided under the crankcase 33. An oil passage 53 is formed on a wall portion of the crankcase 33 on the air-intake system side to lead the oil from the oil tank 52 to the engine-side mounting face 43 of the oil cooler 50.

An oil gallery 54 is formed within the wall portion of the engine E to communicate with various components within the engine E to deliver the oil to the various components. One end of the oil gallery 54 is located in the vicinity of the engine-side mounting face 43 formed on the outer wall portion of the crankcase 33 to communicate with an inside of the oil filter 51. The engine-side mounting face 43 is formed such that its normal direction is inclined slightly upward from a horizontal direction.

As defined hereinafter, the X-axis shown in FIG. 3 is parallel to the longitudinal direction of the engine E and its positive side is directed to forward of the engine E. And, Y-axis shown in FIG. 3 is parallel to the normal direction of the engine-side mounting face 43 and its positive side is directed away toward the right side of the engine E (see FIG. 4). Further, Z-axis is perpendicular to the X-axis and the Y-axis, and its positive side is directed upward. The X-axis, the Y-axis, and the Z-axis are identical to the X-axis, the Y-axis, and the Z-axis described below and shown in Figures. For the sake of simplicity, the positive side of the X-axis is a forward side of the watercraft and its negative side is an aft side of the watercraft. And, a positive side of the Y-axis is a front-face side of the oil cooler 50, and its negative side is a rear-face side of the oil cooler 50. Further, a positive side of the Z-axis is an upper side and its negative side is a lower side.

Figure 5:
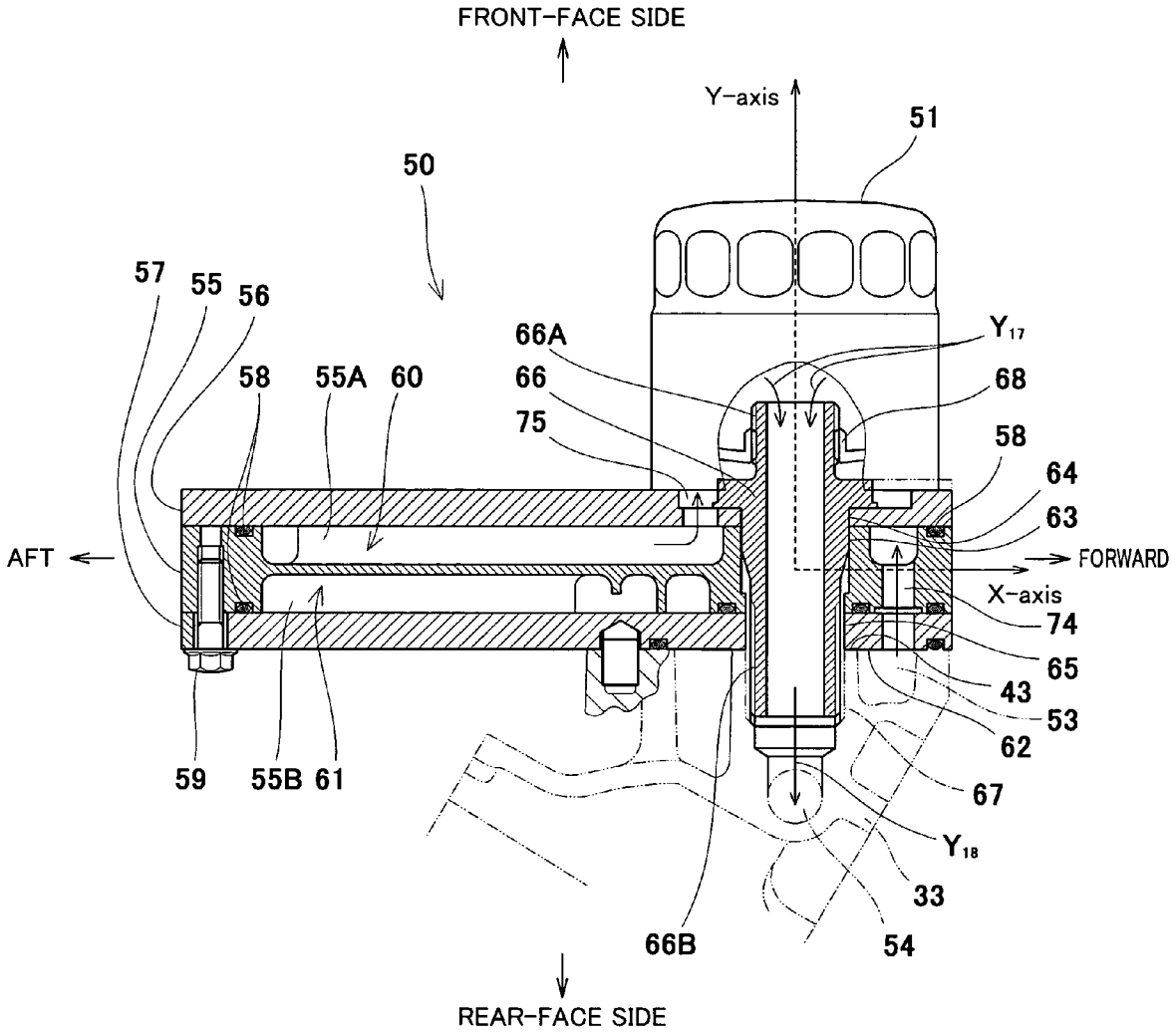
FIG. 5 is a partially enlarged view of the engine in FIG. 3, and a partial cross-sectional view showing an oil cooler and an oil filter mounted on a mounting face of a crankcase.

As shown in a partially cross-sectional view in FIG. 5, the oil cooler 50 comprises a substantially plate shaped passage forming plate 55 formed by casting using metal such as aluminum, a front-face cover plate (first cover member) 56 that covers a front face (one face) of the passage forming plate 55, and a rear-face cover plate (second cover member) 57 that covers a rear-face (an opposite face) of the passage forming plate 55. An oil passage groove 55A is formed on the front face of the passage forming plate 55 by casting, and a cooling water passage groove 55B is formed on the rear-face of the passage forming plate 55.

The front-face cover plate 56 and the rear-face cover plate 57 are connected to each other with the passage forming plate 55 disposed between them. A seal member 58 made of synthetic resin is provided between the plates 56 and 55 and between the plates 57 and 55. The plates 55, 56, and 57 are fixed by means of a screw means 59. By connecting these plates 55, 56, and 57, an oil passage 60 is formed by the oil passage groove 55A and the front-face cover plate 56, and a cooling water passage 61 is formed by the cooling water passage groove 55B and the rear-face cover plate 57. An oil-cooler side mounting face 62 is provided on the rear face of the rear-face cover plate 57. The oil-cooler side mounting face 62 is a contact face with which the oil cooler 50 is mounted on the engine E.

The passage forming plate 55, the front-face cover plate 56, and the rear-face cover plate 57 are provided with holes 63 to 65 each having a relatively-large diameter, respectively. The holes 63 to 65 are configured so that their center axes conform to one another when the plates 55, 56, and 57 are fixed by means of the screw means 59, and a tubular mounting bolt 66 having a penetrating hole along a center axis thereof is inserted through the holes 63 to 65. The axial length of the mounting bolt 66 is larger than the thickness of the oil cooler 50. A male screw portion (portion configured to attach and remove the oil filter 51) 66A is formed in an end portion on a front-face side of the mounting bolt 66 to protrude from the front face of the oil cooler 51. A male screw portion (portion configured to attach and remove the oil filter 51) 66B is formed in an end portion on a rear-face side of the mounting bolt 66 to protrude from the rear face of the oil cooler 51.

A female screw portion 67 having a relatively large diameter is formed on the engine-side mounting face 43 of the crankcase 33. The female screw portion 67 communicates with the oil gallery 54. The oil cooler 50 is directly mounted on the outer wall face of the engine E in such a manner that the passage forming plate 55, the front-face cover plate 56, and the rear-face cover plate 57 are fixed by the screw means 59, the oil-cooler side mounting face 62 of the rear-face cover plate 57 and the engine-side mounting face 43 of the crankcase 33 are in contact with each other, and the male screw portion 66B of the mounting bolt 66 inserted through the holes 63 to 65 is screwed to the female screw portion 67 of the engine-side mounting face 43. Also, by mounting the oil cooler 50 on the engine-side mounting face 43 of the crankcase 33, the penetrating hole of the tubular mounting bolt 66 communicates with the oil gallery 54.

The oil filter 51 is provided on the front face of the oil cooler 50. The oil filter 51 is tubular with a bottom and opens at one end thereof. The oil filter 51 contains a filter element (not shown). A female screw portion 68 is provided substantially at a center of an opening of the oil filter 51. The oil filter 51 is directly attached on the front-face cover plate 56 of the oil cooler 50 by screwing the female screw portion 68 to the male screw portion 66A of the mounting bolt 66. Under this condition, the inner space of the oil filter 51 communicates with the oil gallery 54 through the penetrating hole of the mounting bolt 66.

Figure 6A:
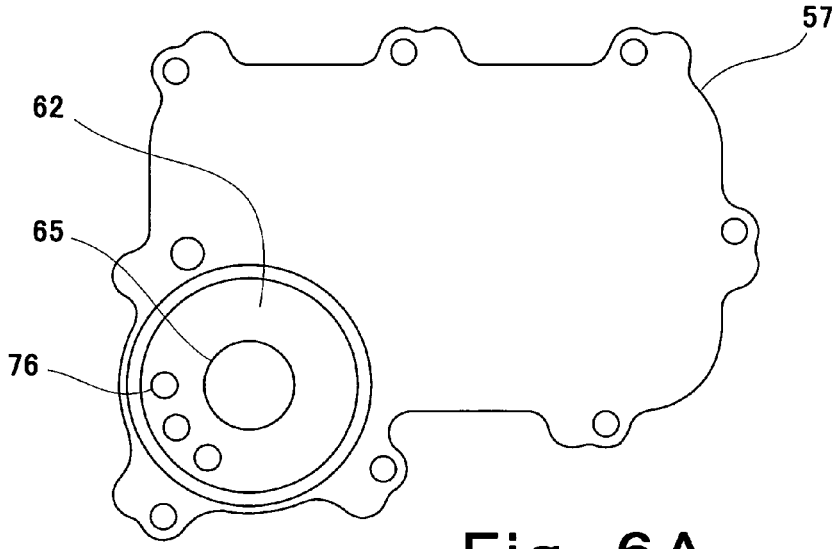
FIG. 6A is a rear view of a cover plate constituting a rear-face of the oil cooler in FIG. 5.
Figure 6B:
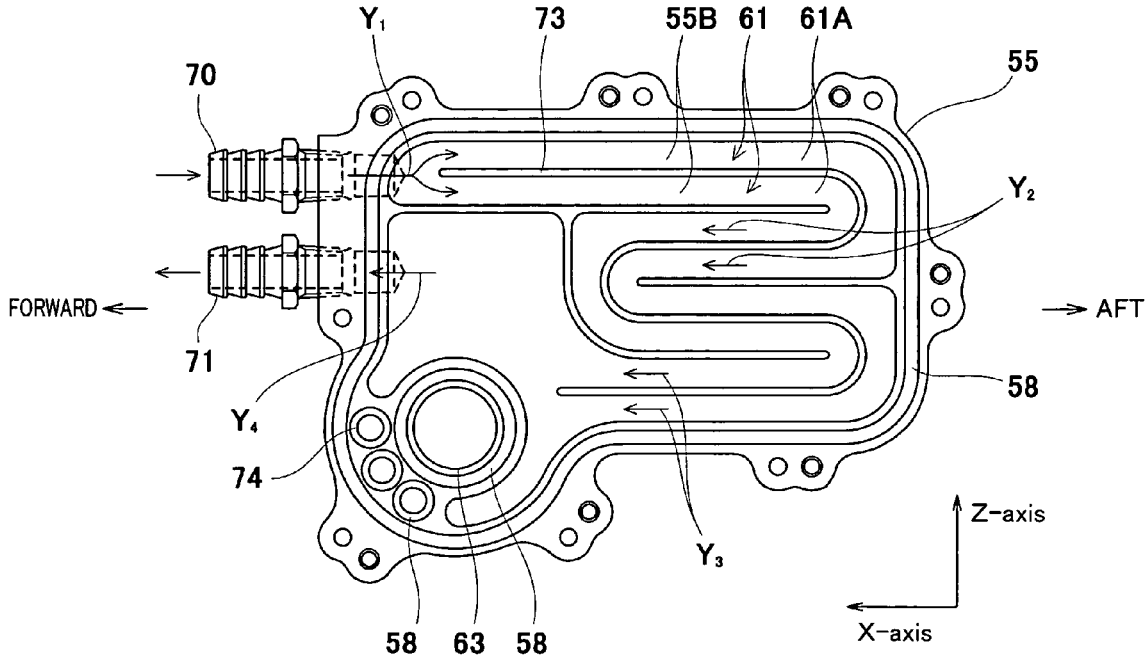
FIG. 6B is a rear view of a passage forming plate, with the cover plate in FIG. 6A removed from the oil cooler in FIG. 5 to expose an inner face of a cooling water passage.

As shown in FIG. 6B, a tubular joint 70 and a tubular joint 71 are attached on a forward end portion of the passage forming plate 55. The cooling water flows into the oil cooler 50 through the joint 70 and flows out of the oil cooler 50 through the joint 71. Tubes 72 are connected to the joints 70 and 71, respectively (see FIG. 3) and the cooling water drawn through the water drawing hole 18 formed in the pump casing 14 in FIG. 1 flows through the joints 70 and 71.

As described above, the cooling water passage groove 55B is formed on the rear-face of the passage forming plate 55 in FIG. 6B. The cooling water passage groove 55B extends from an attaching portion of the joint 70 to an attaching portion of the joint 71, and its passage is sinuously shaped. Specifically, the cooling water passage groove 55B extends from a forward end portion of the plate 55 toward an aft end portion thereof and is bent at a position to return toward the forward end portion, which is repeated. Finally, the cooling water passage groove 55B reaches the joint 71. A fin 73 is provided within and along the passage of the cooling water passage groove 55B.

In the cooling water passage groove 55B so configured, the cooling water flows thereinto though the joint 70 (see arrow Y1), flows along the sinuously-shaped groove 55B (see arrows Y2 and Y3), and is finally delivered outside through the joint 71 (see arrow Y4). By removing the rear-face cover plate 57 in FIG. 6A from the passage forming plate 55, the cooling water passage groove 55B is exposed, and hence, an inner face 61A of the cooling water passage 61 is entirely exposed.

As shown in FIG. 6B, a plurality of oil holes 74 are formed to penetrate the passage forming plate 55 in the vicinity of the hole 63 formed in the passage forming plate 55. As shown in FIG. 6A, a plurality of oil holes 76 are formed to penetrate the rear-face cover plate 57 in the vicinity of the hole 65 formed in the rear-face cover plate 57. By attaching the passage forming plate 55 on the rear-face cover plate 57, the oil holes 74 and 76 are combined to be formed into an oil route. The oil route opens into the oil-cooler side mounting face 62 (see FIG. 5). By mounting the oil cooler 50 on the engine-side mounting face 43, the oil route communicates with the passage 53 formed in the wall portion of the crankcase 33 to allow the oil flowing through the passage 53 to be drawn to the oil passage 60 (see FIG. 5). As shown in FIG. 6B, on the rear-face of the passage forming plate 55, a seal member 58 is provided on each of a peripheral portion of the plate 55, a peripheral portion of the hole 63, and a peripheral portion of the oil hole 74, to inhibit leakage of the oil and the cooling water to outside.

Figure 7A:
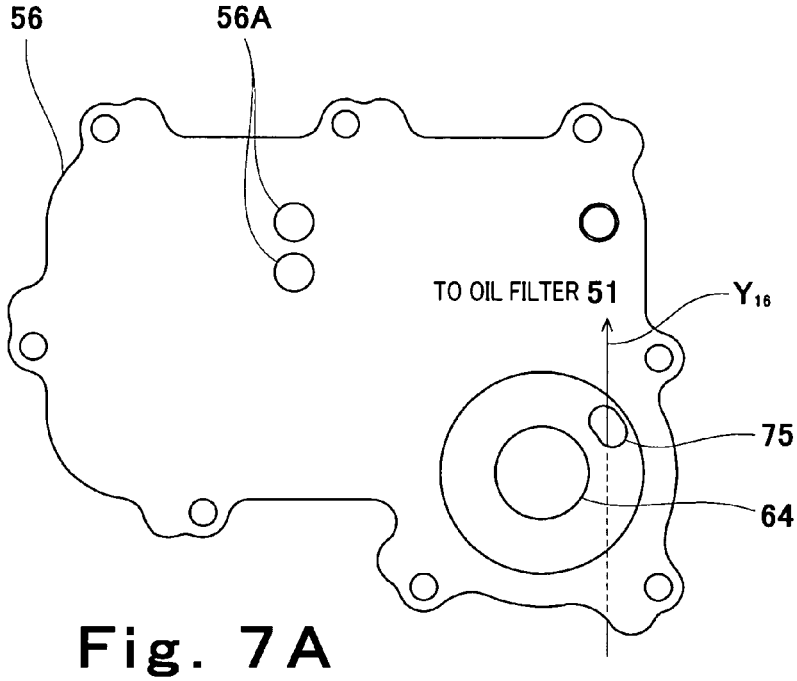
FIG. 7A is a front view of a cover plate constituting a front face of the oil cooler in FIG. 5.
Figure 7B:
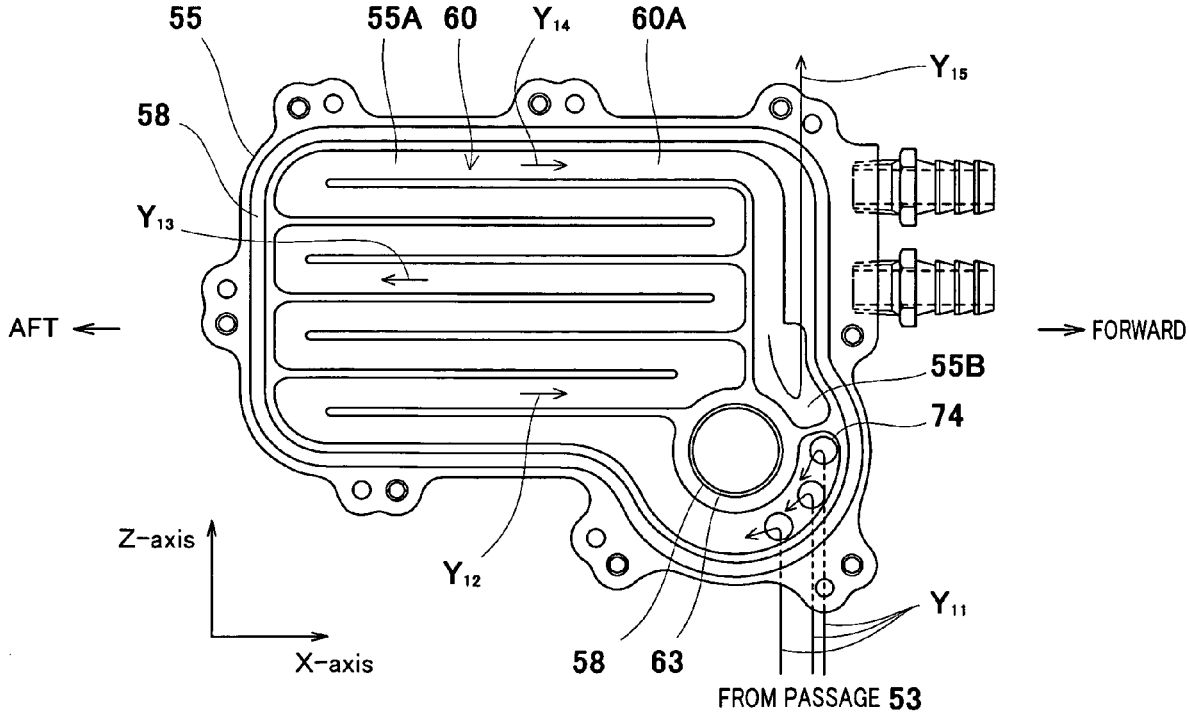
FIG. 7B is a front view of a passage forming plate, with the cover plate in FIG. 7A removed from the oil cooler in FIG. 5 to expose an inner face of an oil passage.

As shown in FIG. 7B, the oil passage groove 55A is formed on the passage forming plate 55. The oil passage groove 55A starts from the oil holes 74 formed in the passage forming plate 55 and extends to a terminal point 55B located in the vicinity of the oil holes 74 on the front face of the passage forming plate 55. The oil passage groove 55A is sinuously shaped. More specifically, the oil passage groove 55A extends from the oil holes 74, is bent at an aft end portion of the plate 55, and then extends toward a forward end portion of the pate 55. This pattern is repeated one or more times, until the oil passage groove 55A reaches the terminal point 55B in the vicinity of the oil holes 74.

In the oil passage groove 55A so configured, the oil flows thereinto through the oil holes 74 (see arrows Y11), flows along the sinuous oil passage groove 55A (see arrows Y12 to Y14), and flows to the terminal point 55B in the vicinity of the oil holes 74. By removing the front-face cover plate 56 in FIG. 7A from the passage forming plate 55, the oil passage groove 55A is exposed, and hence, an inner face 60A of the oil passage 60 is entirely exposed.

As shown in FIG. 7A and FIG. 5, an oil hole 75 is formed to penetrate the front-face cover plate 56 at a position of the front-face cover plate 56 corresponding to the terminal point 55B of the oil passage groove 55A. The oil hole 75 communicates with the inner space of the oil filter 51 directly attached on the front face of the oil cooler 50 (see FIG. 5) to lead the oil flowing within the oil passage 60 to the oil filter 51. As shown in FIG. 7B, on the front face of the passage forming plate 55, the seal member 58 is provided on each of the peripheral portion of the plate 55 and the peripheral portion of the hole 63 to inhibit leakage of the oil from its proper route to outside.

Furthermore, a plurality of sensor attaching holes 56A are formed to penetrate the front-face cover plate 56 and to communicate with the oil passage 60. Within the sensor attaching holes 56A, various types of sensors are attached. With the oil cooler 50 mounted on the engine E, the sensor attaching holes 56A open toward the outer lateral side of the engine E. As shown in FIG. 4, a hydraulic-pressure sensor 77 and an oil-temperature sensor 78 are attached within the sensor attaching holes 56A. The sensor attaching holes 56A allow the sensors 77 and 78 to be easily attached and detached.

In the personal watercraft comprising the oil cooler 50, the cooling water taken in from outside through the water drawing hole 18 (see FIG. 1) formed in the pump casing 14 is delivered through the tube 72 and flows into the oil cooler 50 through the joint 70 as shown in FIG. 6B. The cooling water flows along the cooling water passage 61 within the oil cooler 50 and is discharged outside the oil cooler 50 through the joint 71.

The cooling water discharged from the oil cooler 50 is delivered to a water jacket (not shown) formed in the cylinder block 32 for use as the cooling water to cool the cylinder block 32. Since the cooling water discharged from the oil cooler 50 is slightly higher in temperature than the cooling water before flowing into the oil cooler 50, the cylinder block 32 is inhibited from being cooled excessively, thereby inhibiting dilution of the oil.

As shown in FIG. 4, the oil temporarily stored within the oil tank 52 flows within the passage 53 formed in the wall portion of the crankcase 33 and reaches the engine-side mounting face 43 (see arrow Y10). Then, as shown in FIG. 7B, the oil flows into the oil passage 60 formed by the passage forming plate 55 (see arrow Y11) through the oil holes 76 of the rear-face cover plate 57 (see FIG. 6A) and the oil holes 74 of the passage forming plate 55 (see FIG. 6B). Then, the oil flows along the oil passage 60 within the oil cooler 50 and is delivered to the oil filter 51 through the oil hole 75 of the front-face cover plate 56 (see arrows Y15 and Y16). The oil flowing into the oil filter 51 is filtered inside thereof. Then, as shown in FIG. 5, the oil flows within the mounting bolt 66 (see arrow Y17) and flows through the oil gallery 54 (see arrow Y18) formed in the wall portion of the crankcase 33 to be delivered to the components within the engine E.

As described above, since low-temperature cooling water flows within the cooling water passage 61 on the rear-face side of the passage forming plate 55 and high-temperature oil flows within the oil passage 60 on the front-face side of the passage forming plate 55, the oil is cooled by heat exchange with the cooling water. In addition, since the oil passage 60 is sinuously shaped, a relatively long cooling time is ensured, and hence the oil cooler 50 has a high cooling capability. Further, the fin 73 provided within the cooling water passage 61 allows the oil to be cooled efficiently.

The hydraulic-pressure sensor 77 and the oil-temperature sensor 78 attached within the sensor mounting holes 56A penetrating the front-face cover plate 56 are in contact with the oil flowing within the oil passage 60. Therefore, the hydraulic-pressure sensor 77 detects information relating to the pressure of the oil, and the oil-temperature sensor 78 detects information relating to the temperature of the oil.

In the oil cooler 50 configured as described above, by removing the screw means 59 and the mounting bolt 66, the oil cooler 50 is disassembled into the passage forming plate 55, the front-face cover plate 56, and the rear-face cover plate 57. As a result, since the inner face 60A of the oil passage 60 and the inner face 61A of the cooling water passage 61 are exposed, the interior of the oil cooler 50 is easily cleaned. In the personal watercraft comprising the oil cooler 50, since the oil cooler 50 is directly mounted on the outer wall face of the crankcase 33, externally attached pipes to lead the oil flowing within the oil gallery 54 to the oil passage 60 of the oil cooler 50 become unnecessary. As a result, piping configuration around the engine E is simplified, lightweight personal watercraft is achieved, and manufacturing cost is reduced.

While in this embodiment, the oil cooler 50 is placed within the space 37 between the engine E and the air-intake pipe 35, the oil cooler 50 may be placed within the space 42 between the engine E and the exhaust pipes 41. In this case, the engine-side mounting face 43 of the oil cooler 50 is formed on a side face of the crankcase on the exhaust pipe side.

Embodiment 2

An oil cooler having another configuration will be described with reference to FIGS. 8 to 11. In FIGS. 8 to 11, the same reference numerals as those in FIGS. 1 to 7 denote the same or corresponding parts. The oil cooler of this embodiment is applicable to the personal watercraft described with reference to FIGS. 1 and 2. As shown in a side view of the engine E in FIG. 8, an oil cooler 80 is provided within the space 37 between the air-intake pipe 35 and the crankcase 33, as in the oil cooler 50 of the first embodiment.

Figure 8:
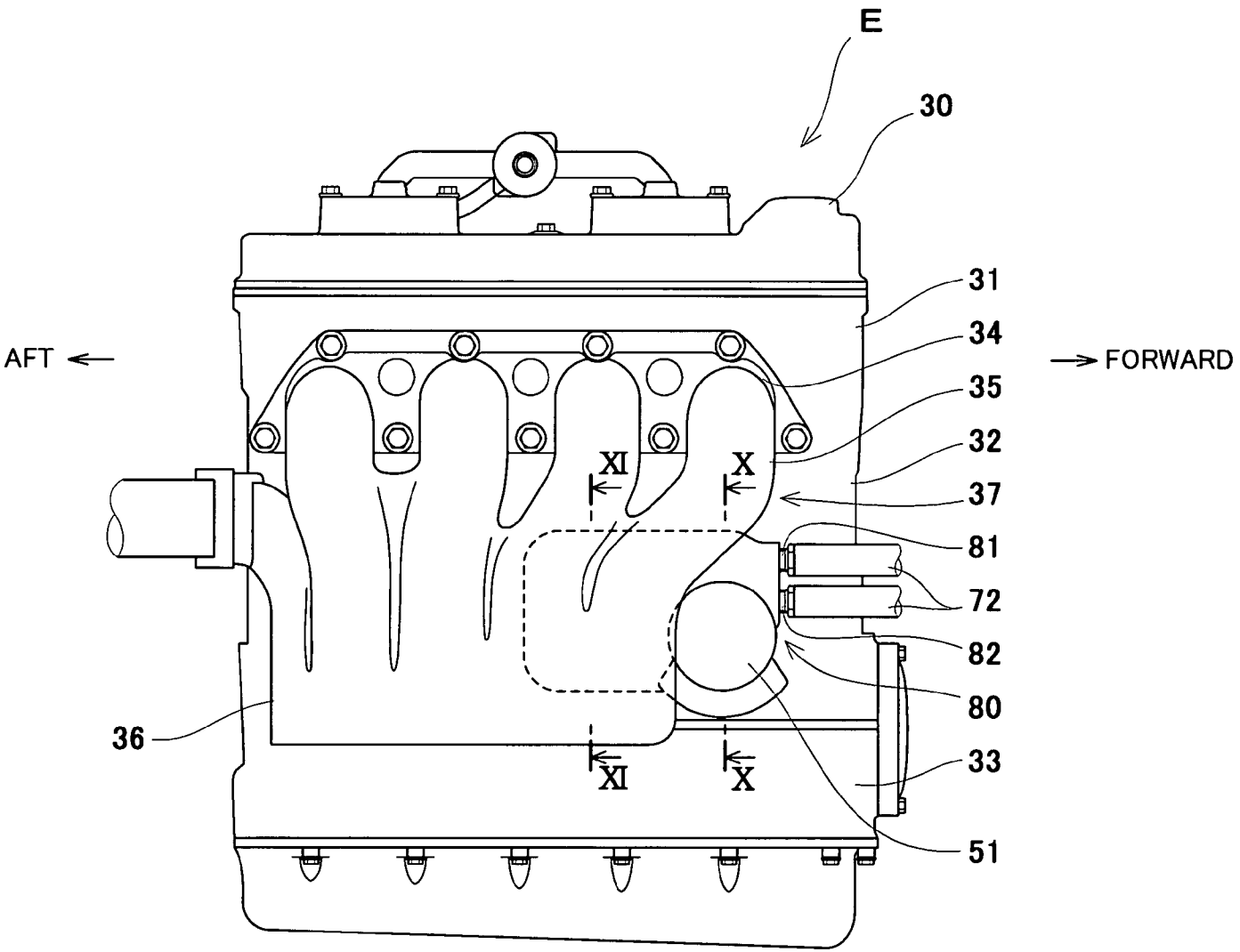
FIG. 8 is a side view of the engine comprising an oil cooler according to another embodiment of the present invention.
Figure 9:
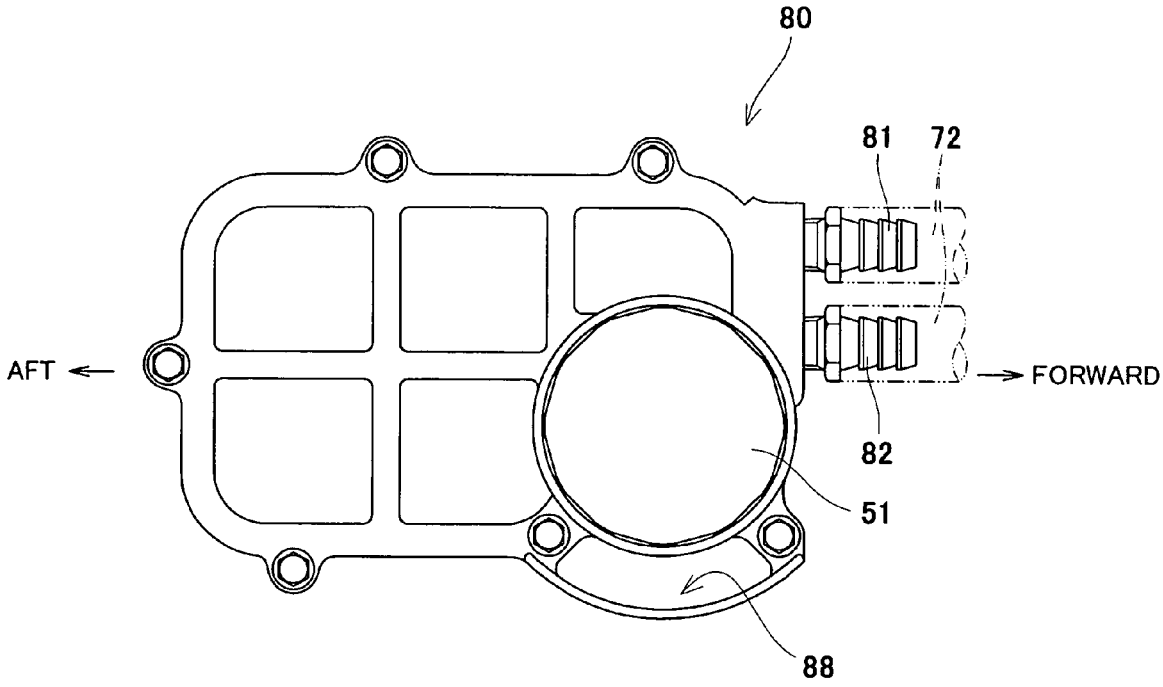
FIG. 9 is a view of an external appearance of the oil cooler in FIG. 8.

As shown in a front view of the oil cooler 80 in FIG. 9, the oil cooler 80 is substantially rectangular. The oil cooler 80 is provided with a joint 81 and a joint 82 at a forward end portion thereof. The cooling water flows into the oil cooler 80 through the joint 81 and flows out of the oil cooler 80 through the joint 82. The ends of the tubes 72 are connected to the joints 81 and 82, respectively. The oil filter 51 is attached on a front face of the oil cooler 80. As shown in FIG. 8, the oil cooler 80, which is placed within the space 37 between the crankcase 33 and the air-intake pipe 35, is configured such that the oil filter 51 is substantially entirely exposed when the engine E is seen from the air-intake system side.

Figure 10:
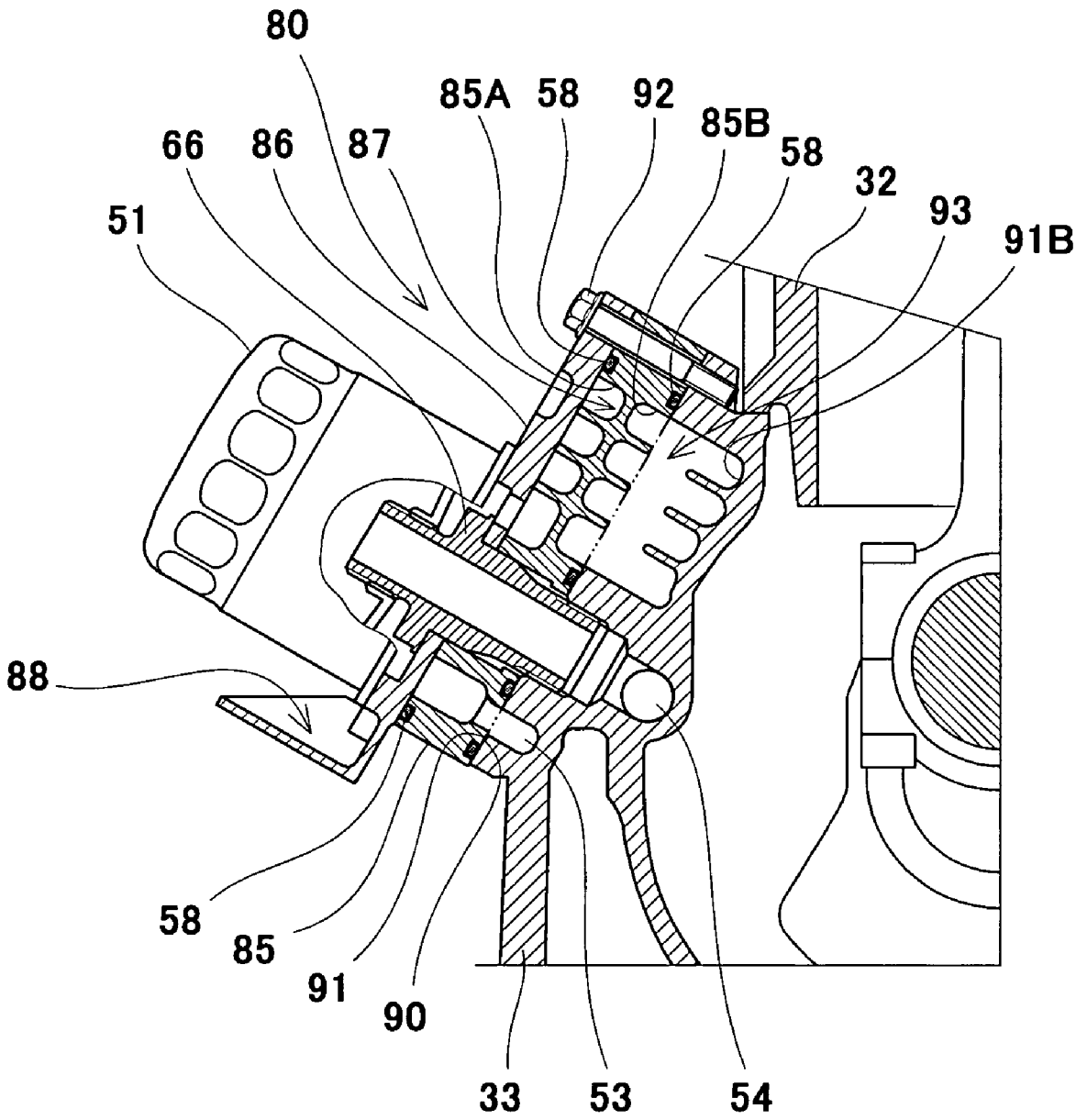
FIG. 10 is a cross-sectional view of the oil cooler taken along line X—X in FIG. 8.
Figure 11:
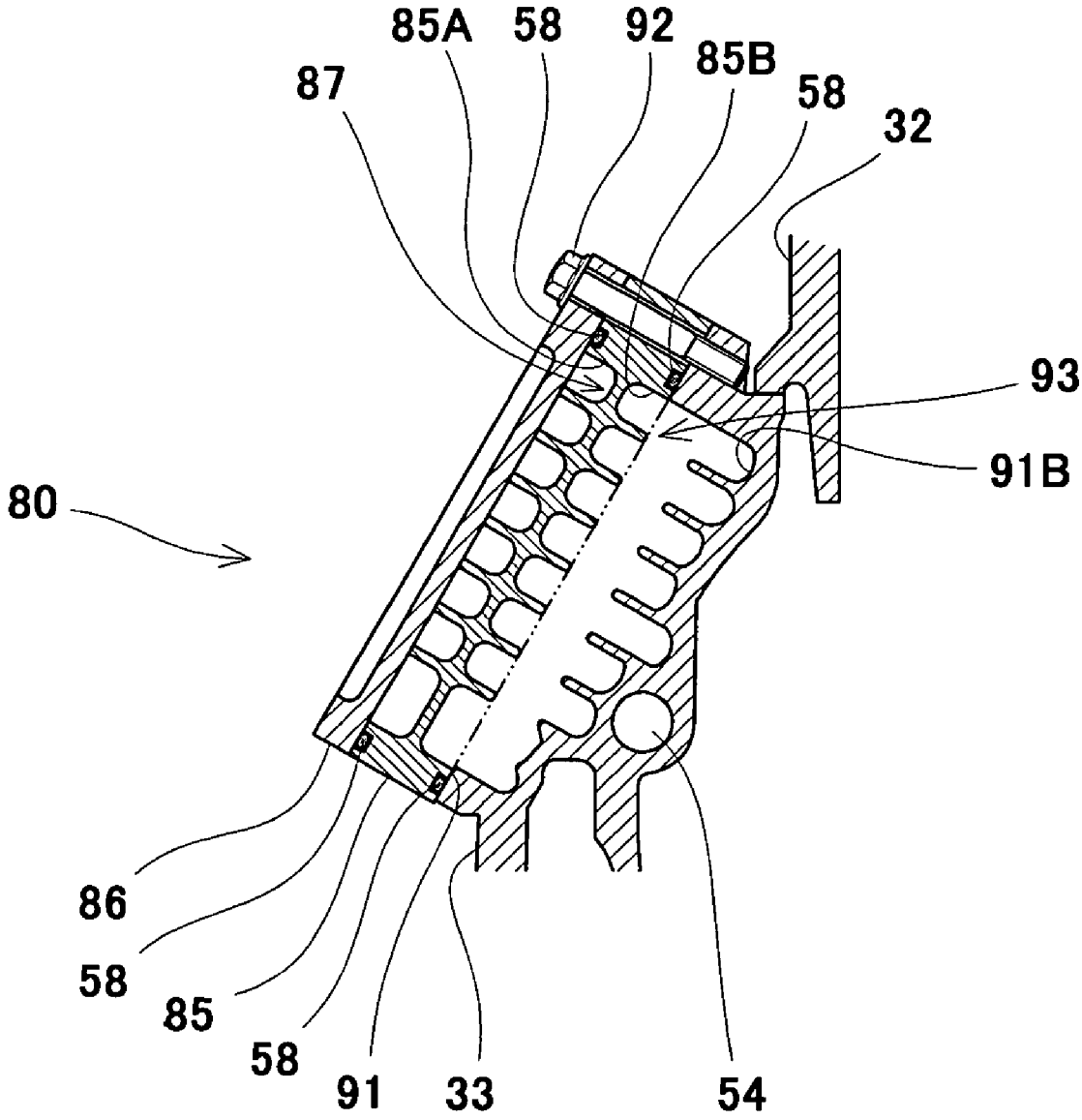
FIG. 11 is a cross-sectional view of the oil cooler taken along line XI—XI in FIG. 8.

As shown in FIGS. 10 and 11, the rear-face over plate 57 of the oil cooler 50 of the first embodiment is not provided on the oil cooler 80 of this embodiment, and a rear-face of a passage forming plate 85 is directly attached on the outer wall face of the crankcase 33.

As shown in FIGS. 10 and 11, the oil cooler 80 comprises a substantially plate-shaped passage forming plate 85 formed by casting using metal such as aluminum. An oil passage groove 85A is formed on a front face of the passage forming plate 85 and a first cooling water passage groove 85B is formed on a rear-face of the passage forming plate 85. The oil passage groove 85A and the first cooling water passage groove 85B have structures similar to those of the oil passage groove 55A and the cooling water passage groove 55B of the first embodiment. The front face of the passage forming plate 85 is covered with a front-face cover plate 86 and an oil passage 87 is formed by the front-face cover plate 86 and the oil passage groove 85A.

As shown in FIGS. 9 and 10, the front-face cover plate 86 is provided with an oil-receiving portion 88. As shown in FIG. 9, the oil-receiving portion 88 is provided below the oil filter 51. The oil-receiving portion 88 is formed by circular-arc shaped plate member to surround a lower portion of the oil filter 51. The oil-receiving portion 88 extends from the front face of the front-face cover plate 86 along a center axis (toward the front face) of the oil filter 51. The oil-receiving portion 88 serves to receive oil that leaks out when the oil filter 51 is removed to allow the filter element to be changed.

The oil-receiving portion 88, which is formed on the front-face cover plate 86 forming the oil passage 87, serves as a heat-release fin to release more heat of the oil flowing within the oil passage 87 to outside. The oil-receiving portion 88 may be formed independently of the front-face cover plate 86 and thereafter may be attached on the front-face cover plate 86. Alternatively, the oil-receiving portion 88 may be cast integrally with the front-face cover plate 86. In this case, the number of components is reduced and manufacturing steps is reduced.

As shown in FIG. 10, a rear-face of the passage forming plate 85 forms an oil cooler-side mounting face 90 of the oil cooler 80. An engine-side mounting face 91 of the oil cooler 80 is formed on the outer wall face of the crankcase 33 in the vicinity of the oil gallery 54. The front-face cover plate 86 is attached on the front face of the passage forming plate 85, and under this condition, the passage forming plate 85 is mounted on the wall portion of the crankcase 33 by means of the mounting bolt 66 and a screw means 92 to allow the oil cooler-side mounting face 90 to be connected to the engine-side mounting face 91 of the crankcase 33. As in the first embodiment, the oil filter 51 is attached on a front-face end portion of the mounting bolt 66. An inner space of the oil filter 51 communicates with an oil passage 87.

By mounting the oil cooler 80 on the engine-side mounting face 91, the oil passage 87 communicates with the passage 53 formed in a wall portion of the crankcase 33, and further communicates with the oil tank 52 through the passage 53 (see FIG. 4). The oil filter 51 communicates with the oil gallery 54 through the inside of the mounting bolt 66.

A second cooling water passage grove 91B is formed on the engine-side mounting face 91. The second cooling water passage groove 91B is substantially symmetric with respect to the first cooling water passage groove 85B formed on the rear-face of the passage forming plate 85. By mounting the oil cooler 80 on the engine-side mounting face 91, the first cooling water passage groove 85B and the second cooling water passage groove 91B form a cooling water passage 93. The cooling water passage 93 is sinuously shaped in the vicinity of the oil gallery 54, as in the cooling water passage 61 (see FIG. 8) described in the first embodiment, and communicates with the tubes 72 through the joints 81 and 82.

In the oil cooler 80 configured as described above, since it is not necessary to provide the cover plate on the rear-face side (cooling water passage side) of the passage forming plate 85, small-sized and lightweight oil cooler 80 is achieved. In addition, since the cooling water passage 93 is formed by the passage forming plate 85 and the crankcase 33, the crankcase 33 can be cooled. In particular, the oil flowing within the oil gallery 54 located in the vicinity of the cooling water passage 93 can be cooled.

As in the oil cooler 50 described in the first embodiment, the oil cooler 80 is dissembled into the passage forming plate 85 and the front-face cover plate 86 and an inner face of the cooling water passage 93 and an inner face of the oil passage 87 are exposed, by removing the mounting bolt 66 and the screw means 92.

Embodiment 3

An oil cooler having another configuration will be described with reference to FIGS. 12 to 19. The oil cooler of this embodiment is applicable to the personal watercraft described with reference to FIGS. 1 and 2.

Figure 12:
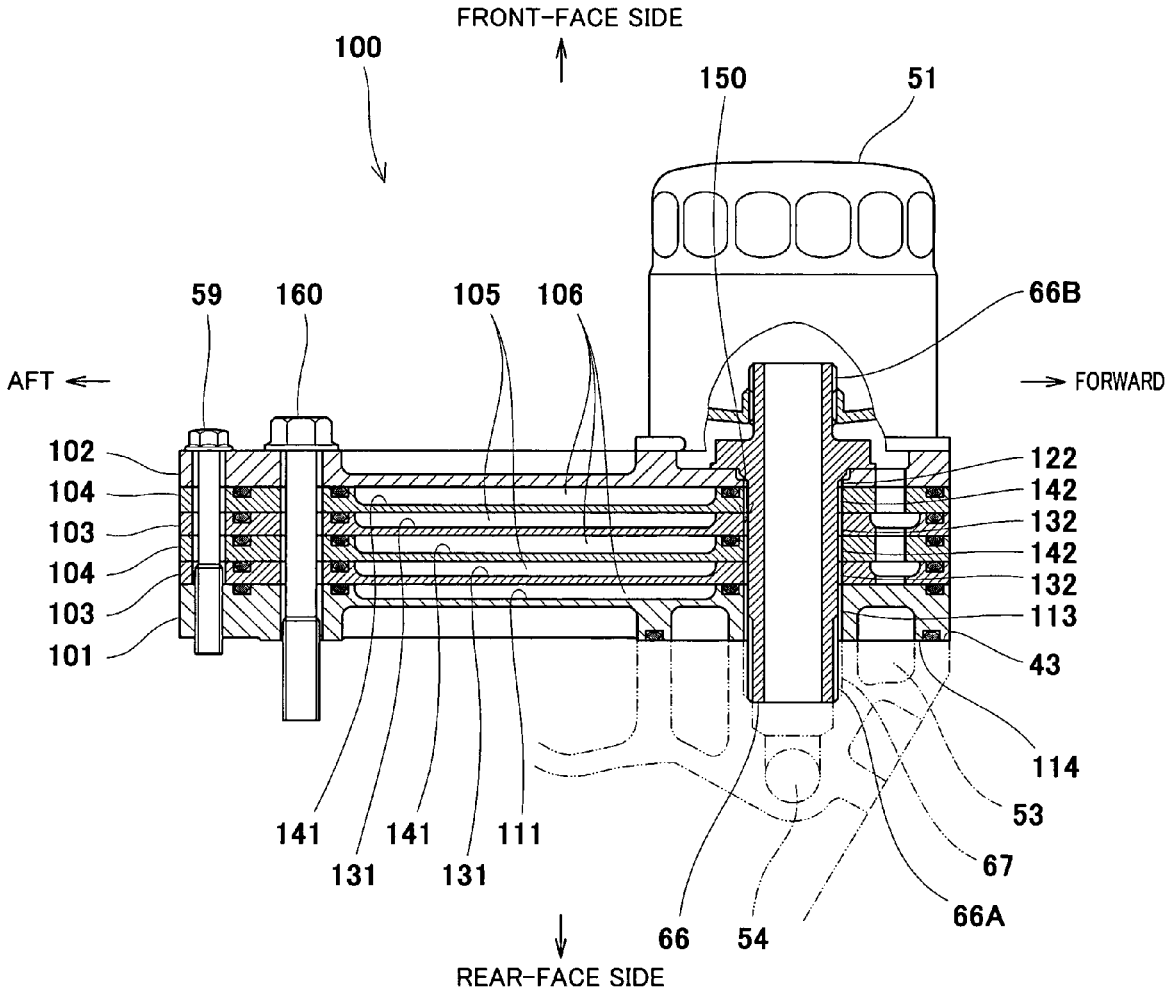
FIG. 12 is a partial cross-sectional view of a two-layered oil cooler according to another embodiment of the present invention.

Referring to FIG. 12, an oil cooler 100 of this embodiment comprises a number of passage forming plates formed by casting using metal such as aluminum between the rear-face cover plate 101 and the front-face cover plate 102. The oil cooler 100 of this embodiment has a two-layered structure comprising two stacked pairs of plates, each pair having an oil passage forming plate 103 and a cooling water passage forming plate 104. The passage forming plate 103 forms the oil passage 105 and the cooling water passage forming plate 104 forms the cooling water passage 106.

Figures 13A, 13B, 13C:
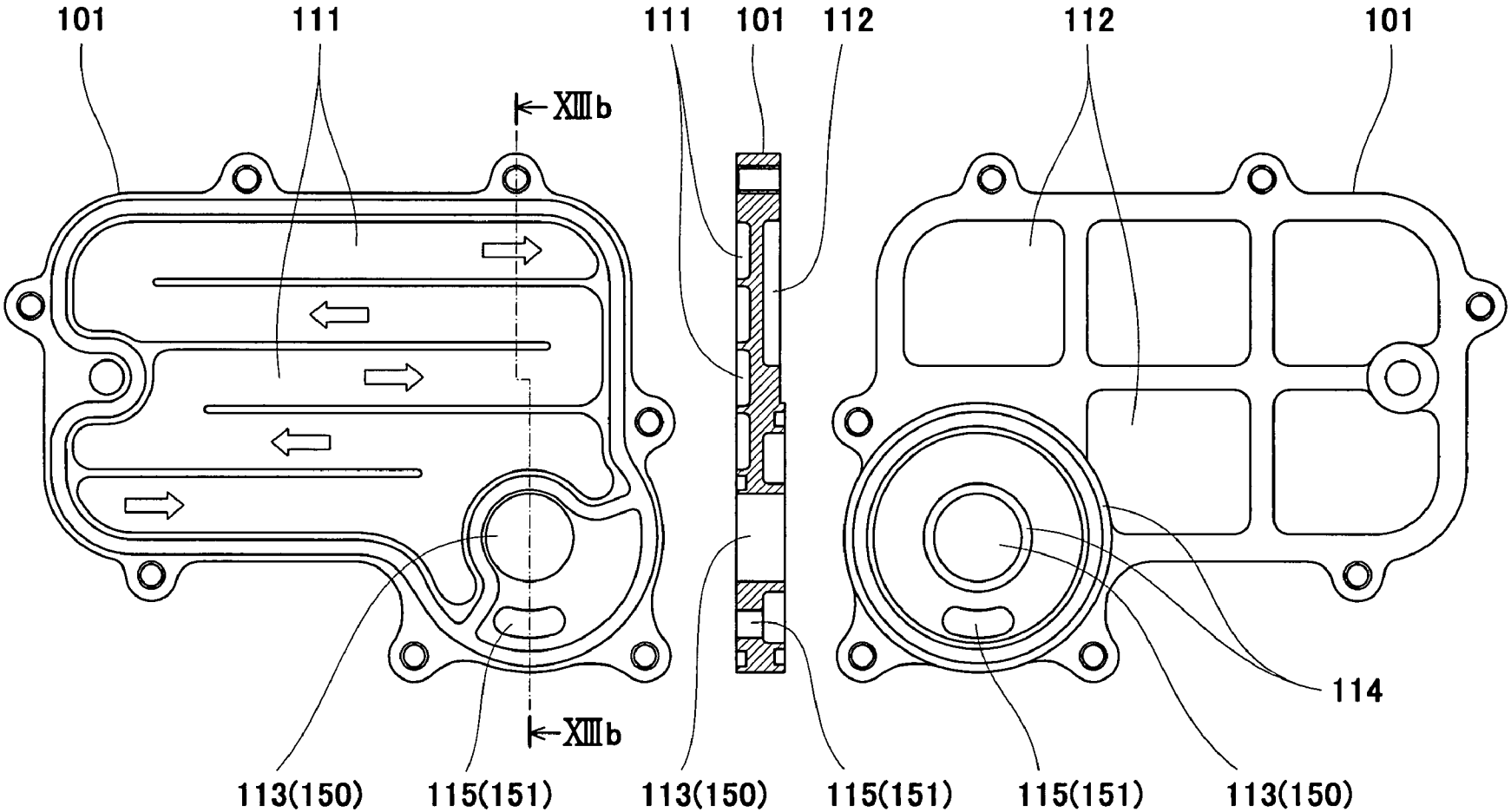
FIG. 13A is a front view of a rear-face cover plate forming the oil cooler in FIG. 12.
FIG. 13B is a cross-sectional view of the rear-face cover plate taken along line XIIIb—XIIIb in FIG. 13A.
FIG. 13C is a rear view of the rear-face cover plate in FIG. 13A.

Referring to FIGS. 13A to 13C, the rear-face cover plate 101 has a predetermined thickness. A cooling water passage groove 111 is formed to extend sinuously on a front face of the rear-face cover plate 101 and concave portions 112 are formed on a rear face thereof by partially thinning the plate 101 for the purpose of light weight. A hole 113 is formed to penetrate the rear-face cover plate 101 in a thickness direction. The hole 113 forms a bolt hole 150 through which the mounting bolt 66 (see FIG. 12) is inserted. An oil cooler-side mounting face 114 of the rear-face cover plate 101 is located in the vicinity of the hole 113. An oil inflow hole 115 is formed on the oil-cooler side mounting face 114 to penetrate the rear-face cover plate 101 in the thickness direction thereof. The oil inflow hole 115 forms an oil inflow passage 151 of the oil cooler 100.

Figures 14A, 14B, 14C:
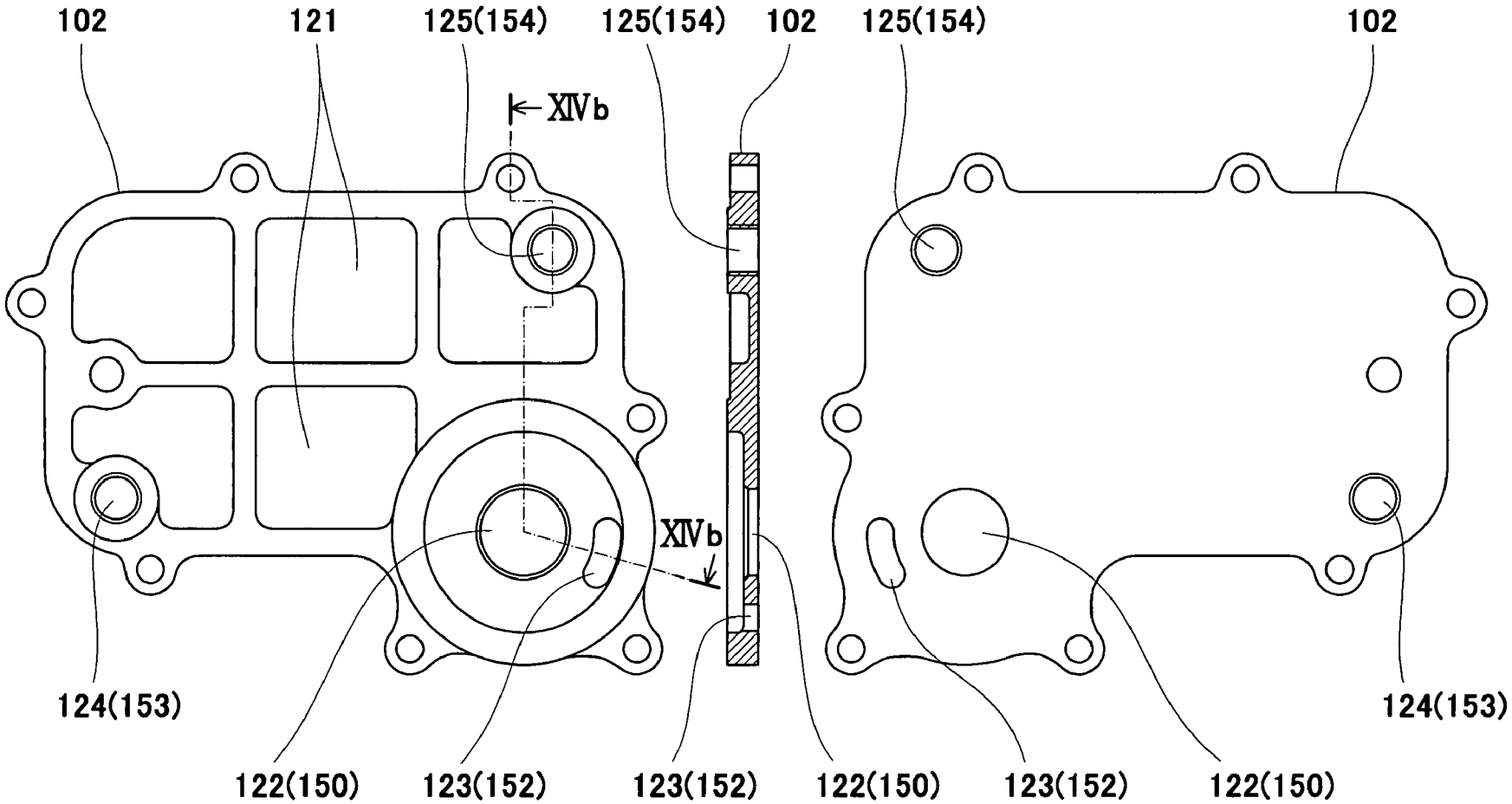
FIG. 14A is a front view of a front-face cover plate forming the oil cooler in FIG. 12.
FIG. 14B is a cross-sectional view of the front-face cover plate taken along line XIVb—XIVb in FIG. 14A.
FIG. 14C is a rear view of the front-face cover plate in FIG. 14A.

As shown in FIGS. 14A to 14C, the front-face cover plate 102 is substantially equal in thickness to the rear-face cover plate 101. A rear face of the front-face cover plate 102 is flat and concave portions 121 are formed on a front face of the front-face cover plate 102 by partially thinning the plate 102 for the purpose of light weight. A large-diameter hole 122 is formed to penetrate the front-face cover plate 102 in the thickness direction. The hole 122 forms a bolt hole 150. An oil outflow hole 123 is formed to penetrate the front-face cover plate 102 in the thickness direction in the vicinity of the hole 122. The oil outflow hole 123 forms an oil outflow passage 152 of the oil cooler 100. Further, a cooling water inflow hole 124 and a cooling water outflow hole 125 are formed to penetrate the front-face cover plate 102 in the thickness direction. The cooling water inflow hole 124 forms a cooling water inflow passage 153 of the oil cooler 100 and the cooling water outflow hole 125 forms a cooling water outflow passage 154 of the oil cooler 100. The cooling water inflow hole 124 and the cooling water outflow hole 125 have threaded inner peripheral faces with which joints configured to connect hoses (not shown) are threadedly engaged.

Figures 15A, 15B, 15C:
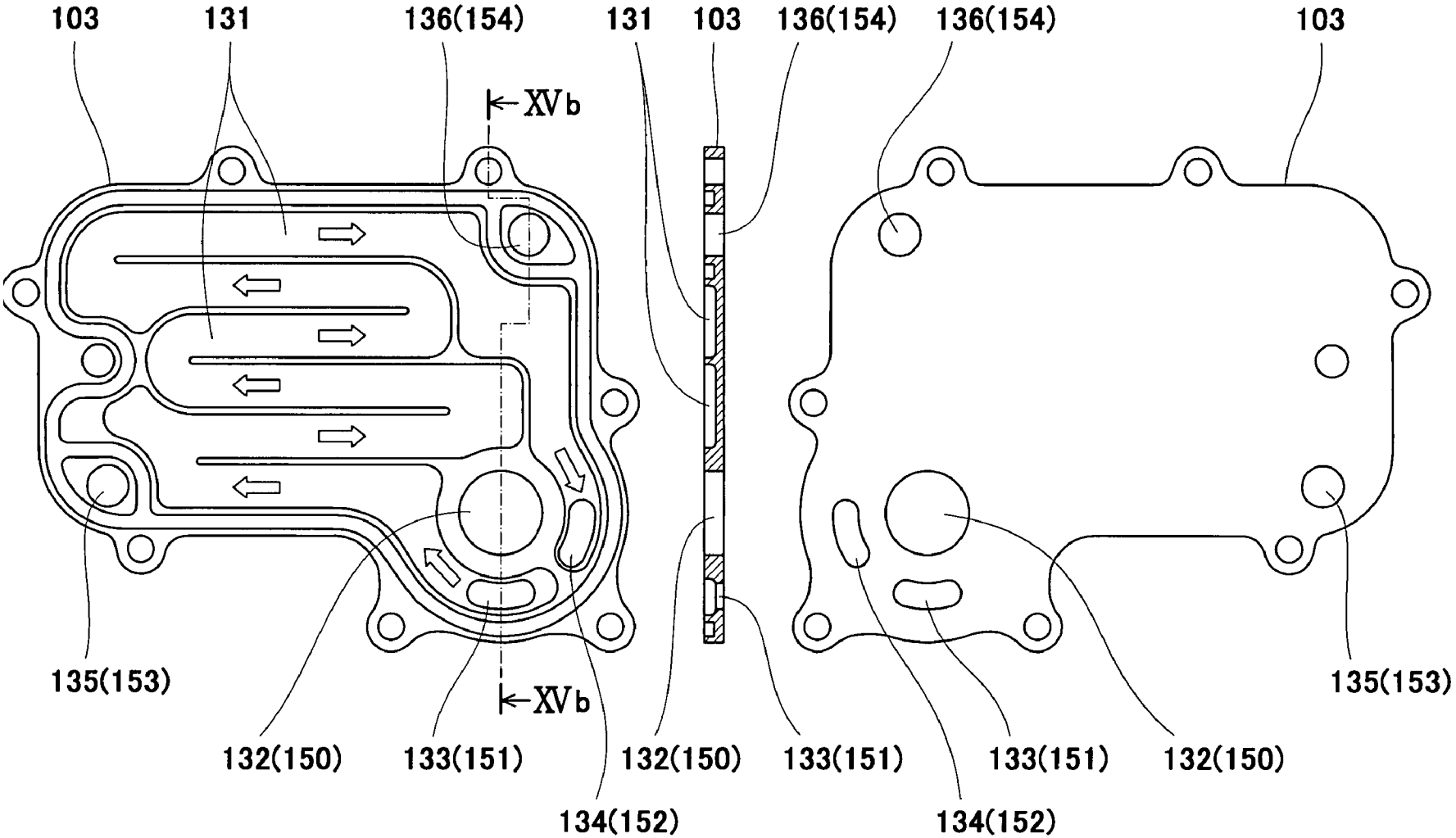
FIG. 15A is a front view of an oil passage forming plate forming the oil cooler in FIG. 12.
FIG. 15B is a cross-sectional view taken along line XVb—XVb of the oil passage forming plate in FIG. 15A.
FIG. 15C is a rear view of the oil passage forming plate in FIG. 15A.

As shown in FIGS. 15A to 15C, the oil passage forming plate 103 has a predetermined thickness smaller than that of the rear-face cover plate 101. An oil groove 131 is formed on a front face of the oil passage forming plate 103 to extend sinuously, and a rear face of the plate 103 is flat. A large-diameter hole 132 is formed to penetrate the oil passage plate 103 in the thickness direction. The hole 132 forms the bolt hole 150. An oil inflow hole 133 and an oil outflow hole 134 are formed to penetrate the oil passage forming plate 103 in the thickness direction thereof in the vicinity of the hole 132. The oil inflow hole 133 forms the oil inflow passage 151 and the oil outflow hole 134 forms an oil outflow passage 152. Further, a cooling water inflow hole 135 and a cooling water outflow hole 136 are formed to penetrate the oil passage forming plate 103 in the thickness direction. The cooling water inflow hole 135 forms a cooling water inflow passage 153 and the cooling water outflow hole 136 forms a cooling water outflow passage 154.

Figures 16A, 16B, 16C:
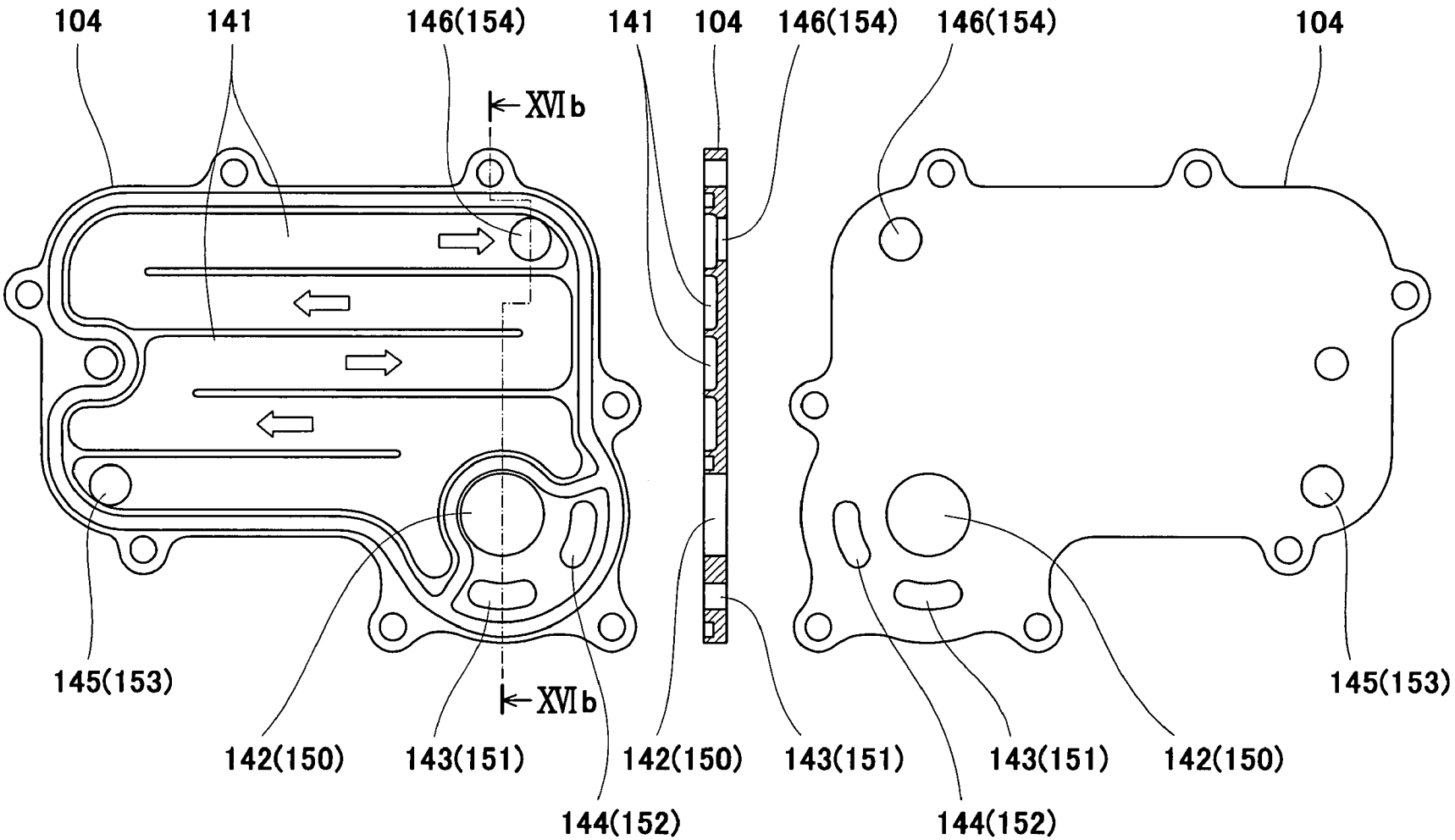
FIG. 16A is a front view of a cooling water passage forming plate forming the oil cooler in FIG. 12.
FIG. 16B is a cross-sectional view of the cooling water passage forming plate taken along line XVIb—XVIb in FIG. 16A.
FIG. 16C is a rear view of the cooling water passage forming plate in FIG. 16A.

As shown in FIGS. 16A to 16C, the cooling water passage forming plate 104 is substantially equal in thickness to the oil passage forming plate 103. A cooling water passage groove 141 is formed on a front face of the cooling water passage forming plate 104 to extend sinuously, and a rear face of the cooling water passage forming plate 104 is flat. A large-diameter hole 142 is formed to penetrate the cooling water passage forming plate 104 in the thickness direction. The hole 142 forms the bolt hole 150. An oil inflow hole 143 and an oil outflow hole 144 are formed to penetrate the cooling water passage forming plate 104 in the thickness direction in the vicinity of the hole 142. The oil inflow hole 143 forms the oil inflow passage 151 and the oil outflow hole 144 forms the oil outflow passage 152. Further, a cooling water inflow hole 145 and a cooling water outflow hole 146 are formed to penetrate the cooling water passage forming plate 104 in the thickness direction thereof. The cooling water inflow hole 145 forms the cooling water inflow passage 153 and the cooling water outflow hole 146 forms the cooling water outflow passage 154.

The oil cooler 100 is configured such that the oil passage forming plate 103 and the cooling water passage forming plate 104 are alternately disposed between the rear-face cover plate 101 and the front-face cover plate 102 to allow passages to be formed between the plates. In the structure of this embodiment, two stacked pairs of oil passage forming plate 103 and cooling water passage forming plate 104 are provided.

As shown in FIG. 12, the first oil passage forming plate 103 is placed in contact with the front face of the rear-face cover plate 101 and a cooling water passage 106 is formed between the cooling water passage groove 111 formed on the rear-face cover plate 101 and the rear face of the first oil passage forming plate 103. The first cooling water passage forming plate 104 is placed in contact with the front face of the first oil passage forming plate 103, and an oil passage 105 is formed between the oil passage groove 131 formed on the first oil passage forming plate 103 and the rear face of the first cooling water passage forming plate 104. The second oil passage forming plate 103 is placed in contact with the front face of the first cooling water passage forming plate 104, and a cooling water passage 106 is formed between the cooling water passage groove 141 formed on the first cooling water passage forming plate 104 and the rear face of the second oil passage forming plate 103. The second cooling water passage forming plate 104 is placed in contact with the front face of the second oil passage forming plate 103, and an oil passage 105 is formed between the oil groove 131 formed on the second oil passage forming plate 103 and the rear face of the second cooling water passage forming plate 104. Further, the front-face cover plate 102 is placed in contact with the front face of the second cooling water passage forming plate 104, and the cooling water passage 106 is formed between the cooling water passage groove 141 formed in the second cooling water passage forming plate 104 and the rear face of the front-face cover plate 102.

As shown in FIG. 12, bolt hole 150 is formed by connecting the plates 101, 102, 103, and 104 to one another such that center axes of the holes 113, 122, 132, and 142 of these plates conform to one another. These plates 101, 102, 103, and 104 are fixed by means of a screw means 59. The oil cooler 100 is directly mounted on the outer wall face of the crankcase 33 in such a manner that the oil cooler-side mounting face 114 is brought into contact with the engine-side mounting face 43 by inserting the tubular mounting bolt 66 into the bolt hole 150 and by screwing the male screw portion 66A of the mounting bolt 66 to the female screw portion 67 on the engine E side. As a result, the penetrating hole of the mounting bolt 66 communicates with the oil gallery 54 formed in the wall portion of the engine E. Also, a screw means 160 is used to fix the oil cooler 100 on the engine-side mounting face 43. As in the oil coolers 50 and 80 described in the first and second embodiments, the oil filter 51 is screwed to the male screw portion 66B at the end portion of the front face of the mounting bolt 66.

Figure 17:
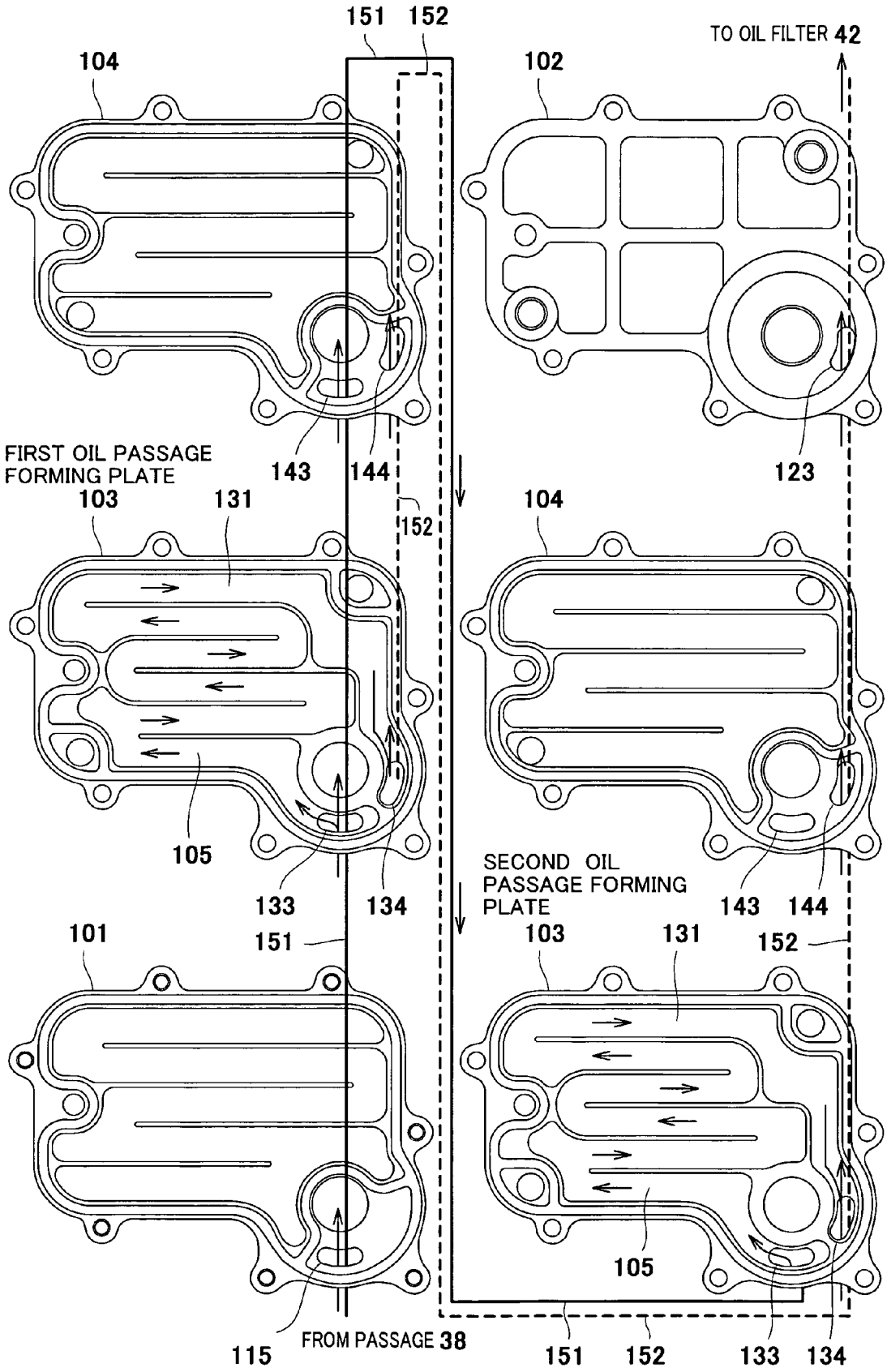
FIG. 17 is a schematic view of an oil passage within the oil cooler in FIG. 16A.

As shown in FIG. 17, the oil inflow holes 115, 133, and 143 of the plates 101, 103, and 104 (typically not including the front-face cover plate 102) communicate with one another to be formed into the oil inflow passage 151, and the oil outflow holes 123, 134, and 144 of the plates 102, 103, and 104 other than the rear-face cover plate 101 communicate with one another to be formed into the oil outflow passage 152. The oil inflow passage 151 communicates with the oil passages 105 formed by the first and second oil passage forming plates 103 and also communicates with a passage 53 (see FIG. 12) formed in the wall portion of the engine E to lead to the oil tank 52 (see FIG. 4). The oil outflow passage 152 communicates with the oil passages 105 and an inner space of the oil filter 51.

In the rear-face cover plate 101, the oil outflow hole 115 is sealed on its periphery to seal between the periphery and the cooling water passage 106. In the cooling water passage forming plate 104, the oil inflow hole 143 and the oil outflow hole 144 are sealed on their peripheries to seal between the peripheries and the cooling water passage 106.

The oil flows from the oil tank 52 into the oil cooler 100 through the passage 53. As shown in FIG. 17, the oil flows through the oil inflow passage 151 and is divided at a position to flow into the oil passages 105 formed by the first and second oil passage forming plates 103. The oil flowing along each of the oil passages 105 is cooled by the cooling water flowing through the cooling water passage 106 as described later with reference to FIG. 18. Then, the oil within the oil passage 105 flows into the oil outflow passage 152 to be merged therein and flows into the inner space of the oil filter 51.

Figure 18:
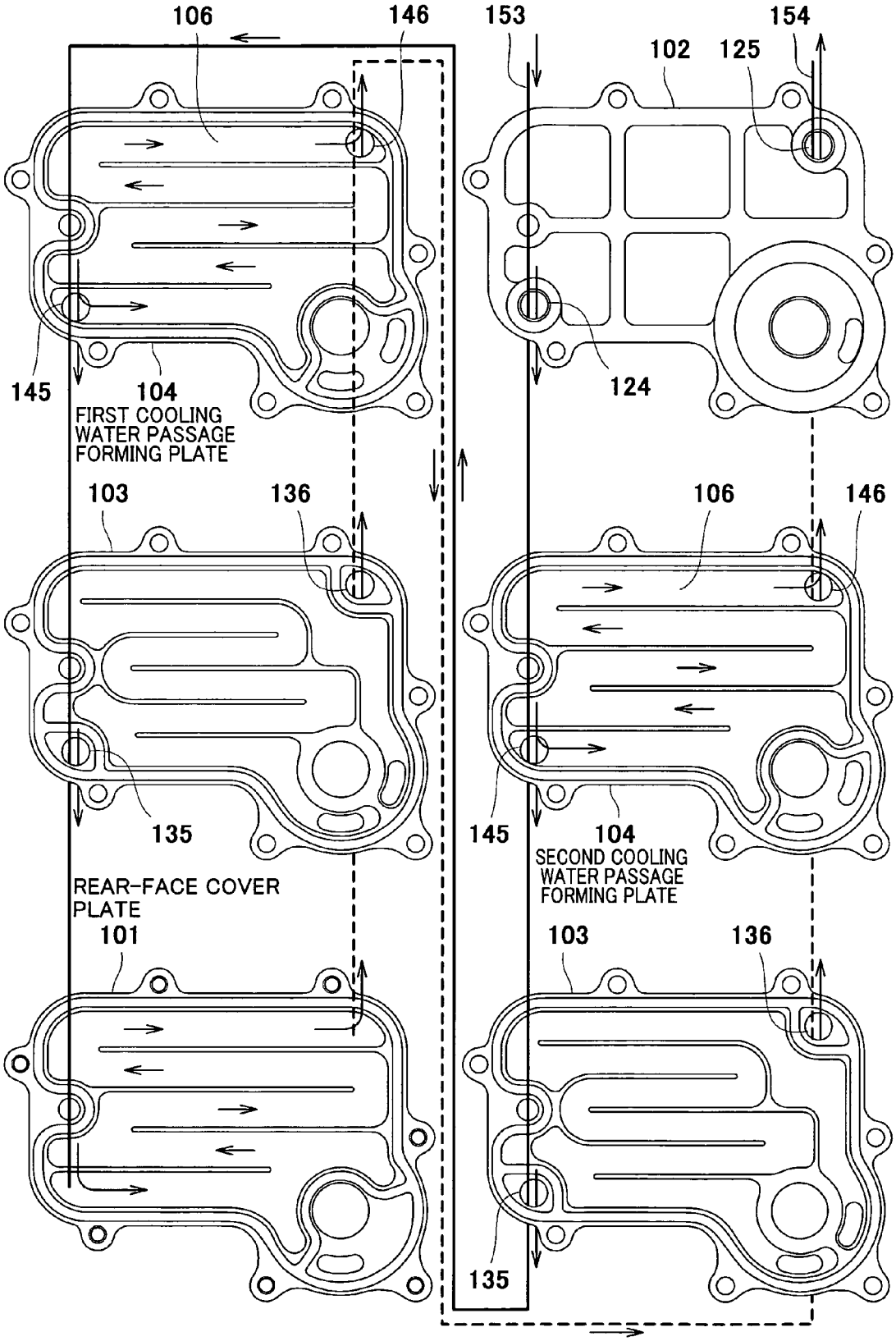
FIG. 18 is a schematic view of a cooling water passage within the oil cooler in FIG. 12.
Figure 19:
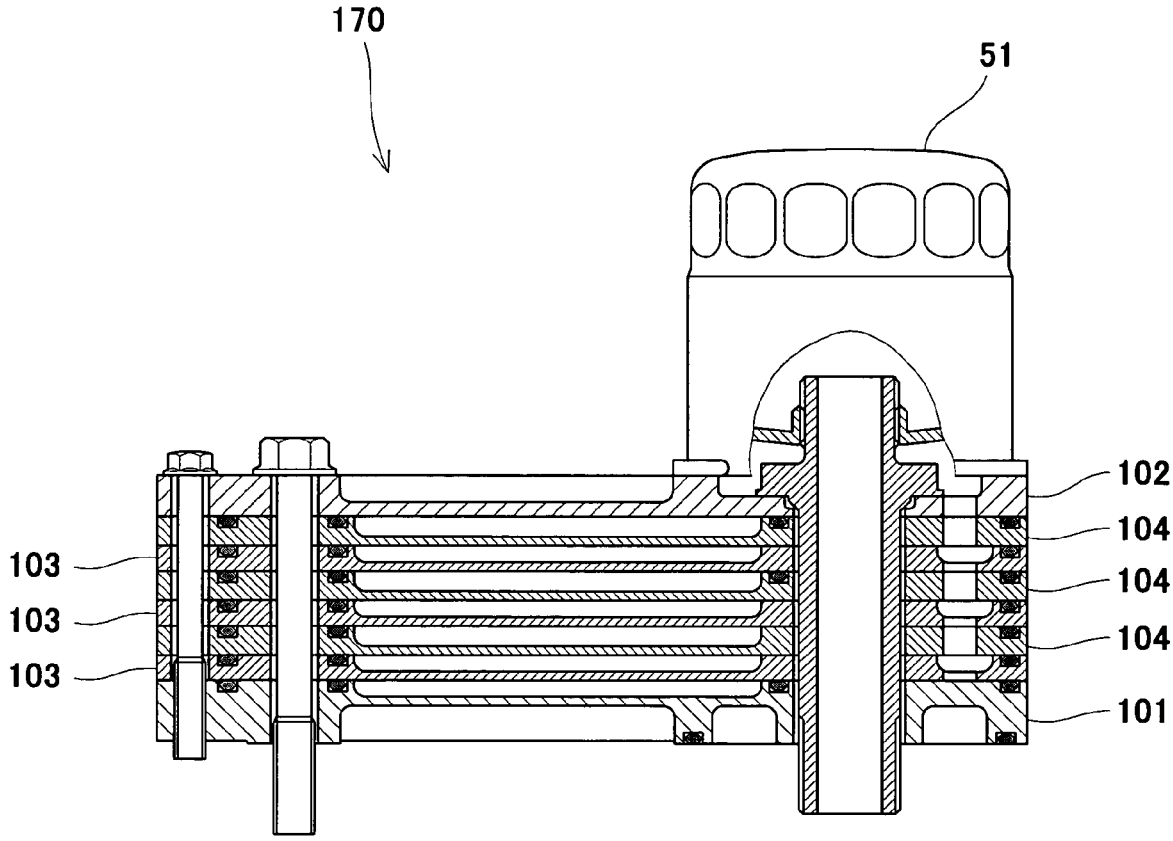
FIG. 19 is a partial cross-sectional view of a three-layered oil cooler obtained by altering part of a configuration of the oil cooler in FIG. 12.

As shown in FIG. 18, the cooling water inflow holes 124, 135, and 145 of the plates 102, 103, and 104 other than the rear-face cover plate 101 communicate with one another to be formed into the cooling water inflow passage 153 and the cooling water outflow holes 125, 136, and 146 communicate with one another to be formed into a cooling water outflow passage 154. The cooling water inflow passage 153 and the cooling water outflow passage 154 communicate with the cooling water passages 106 formed by the first and second cooling water passage forming plates 104. In the oil passage forming plate 103, the cooling water inflow hole 135 and the cooling water outflow hole 136 are sealed on their peripheries to seal between the peripheries and the oil passage 105.

The cooling water flows into the oil cooler 100 through the cooling water inflow hole 124 of the front-face cover plate 102. The cooling water flows through the cooling water inflow passage 153 and is divided at a position to flow into the cooling water passages 106 formed by the first and second cooling water passage forming plates 104 and the rear-face cover plate 101. The cooling water flows along the cooling water passages 106 while cooling the oil flowing through the oil passage 105 as described above with reference to FIG. 17. Then, the cooling water within the cooling water passage 106 flows into the cooling water outflow passage 154 to be merged therein and flows outside through the cooling water outflow hole 125 of the front-face cover plate 102.

The oil cooler 100 of this embodiment can be disassembled into the plates 101, 102, 103, and 104 by removing the screw means 59, 160, and the mounting bolt 66. As a result, the oil passages 105 and the cooling water passages 106 are easily exposed, and hence, are easy to maintain.

Further, a heat exchange area of the oil cooler can be changed freely by adjusting the number of the oil passage forming plates 103 and the cooling water passage forming plates 104. Therefore, the cooling capability can be set flexibly to be adapted to the engine E to be used. The oil cooler 100 has a two-layered structure comprising two stacked pairs of plates, each pair including an oil passage forming plate 103 and a cooling water passage forming plate 104, but this structure is only illustrative. For example, three stacked pairs may be adopted as in an oil cooler 170 in FIG. 19. Such a structure increases the heat exchange area of the oil cooler, and hence improves the cooling capability, in contrast to the oil cooler 100 having the two-layered structure.

Embodiment 4

The oil coolers 50, 80, 100 and 170 described in the first to third embodiments may be each connected to another oil cooler through an adaptor. In this embodiment, as shown in FIGS. 20 to 23, assume that the oil cooler 80 of the second embodiment (hereinafter referred to as "first oil cooler 80") is connected to another oil cooler through the adapter. In FIGS. 20 to 23, the same reference numerals as those in FIGS. 1 to 19 denote the same or corresponding parts. The oil cooler of this embodiment is applicable to the personal watercraft described with reference to FIGS. 1 and 2.

Figure 20:
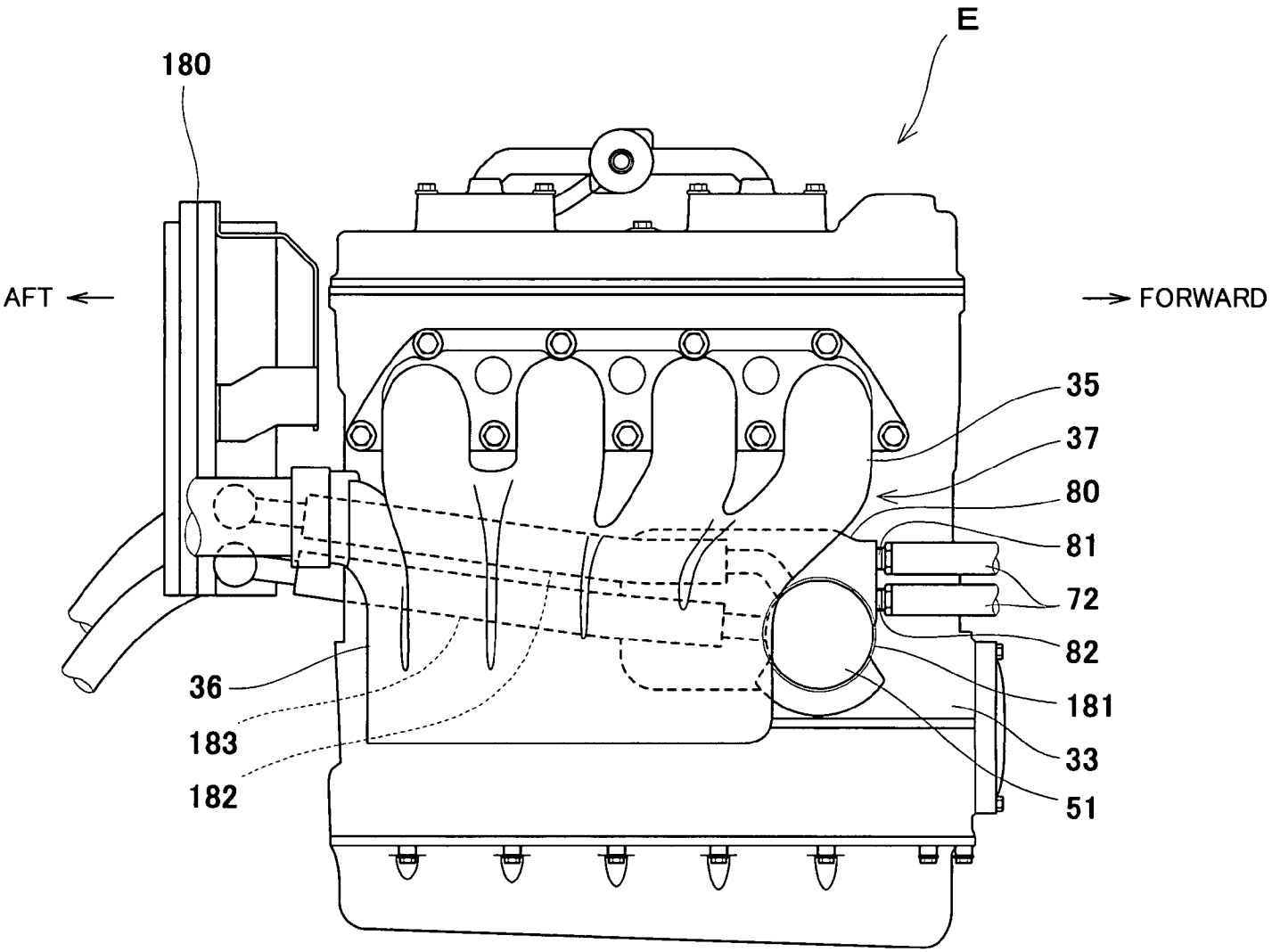
FIG. 20 is a side view of the engine comprising oil coolers (first and second oil coolers) according to another embodiment of the present invention.

As shown in FIG. 20, a second oil cooler 180 independent of the first oil cooler 80 is placed behind the engine E and is connected to the first oil cooler 80 disposed in the space 37 through an adapter 181 and tubes 182 and 183.

Figures 21A, 21B:
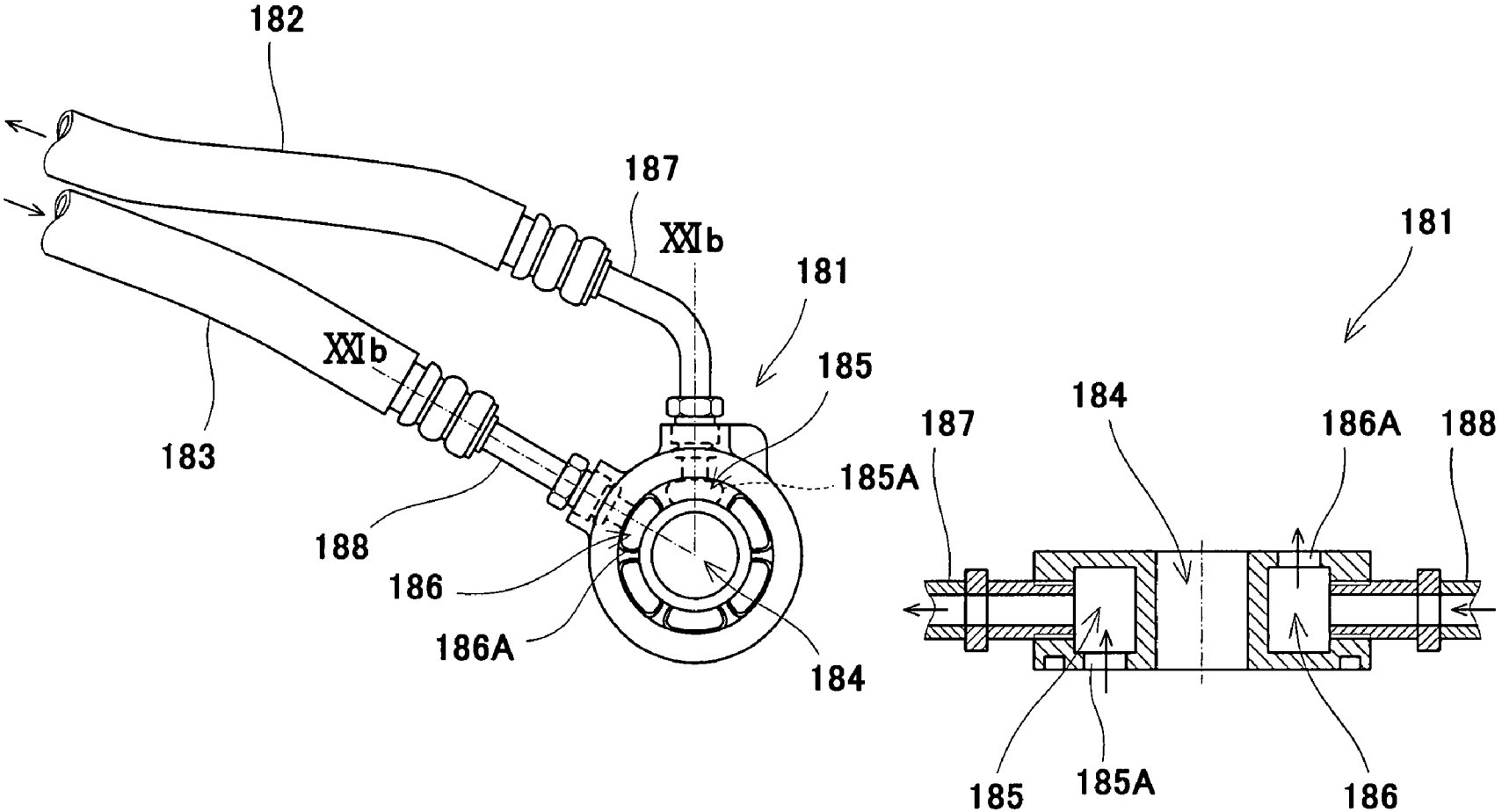
FIG. 21A is a schematic view of an external configuration of an adapter in FIG. 20.
FIG. 21B is a cross-sectional view of the adapter taken along line XXIb—XXIb in FIG. 21A.

As shown in FIGS. 21A and 21B, the adapter 181 is cylindrical to have a length along center axis that is shorter than its width. The adapter 181 has a center hole 184 extending along the center axis, and first and second spaces 185 and 186. The first space 185 communicates with an oil passage 87 of the first oil cooler 80 (see FIG. 10) through a hole 185A formed in one end face of the adapter 181. The second space 186 communicates with an inner space of the oil filter 51 (see FIG. 10) through a plurality of holes 186A formed in an opposite end face of the adapter 181.

Tubular joints 187 and 188 protrude at an outer peripheral portion of the adapter 181. The joint 187 communicates with the first space 185 and is connected to tube 182, which draws the oil from the adapter 181 to the second oil cooler 180. The joint 188 communicates with the second space 186 and is connected to tube 183, which draws the oil from the second oil cooler 180 to the adapter 181.

Figure 22:
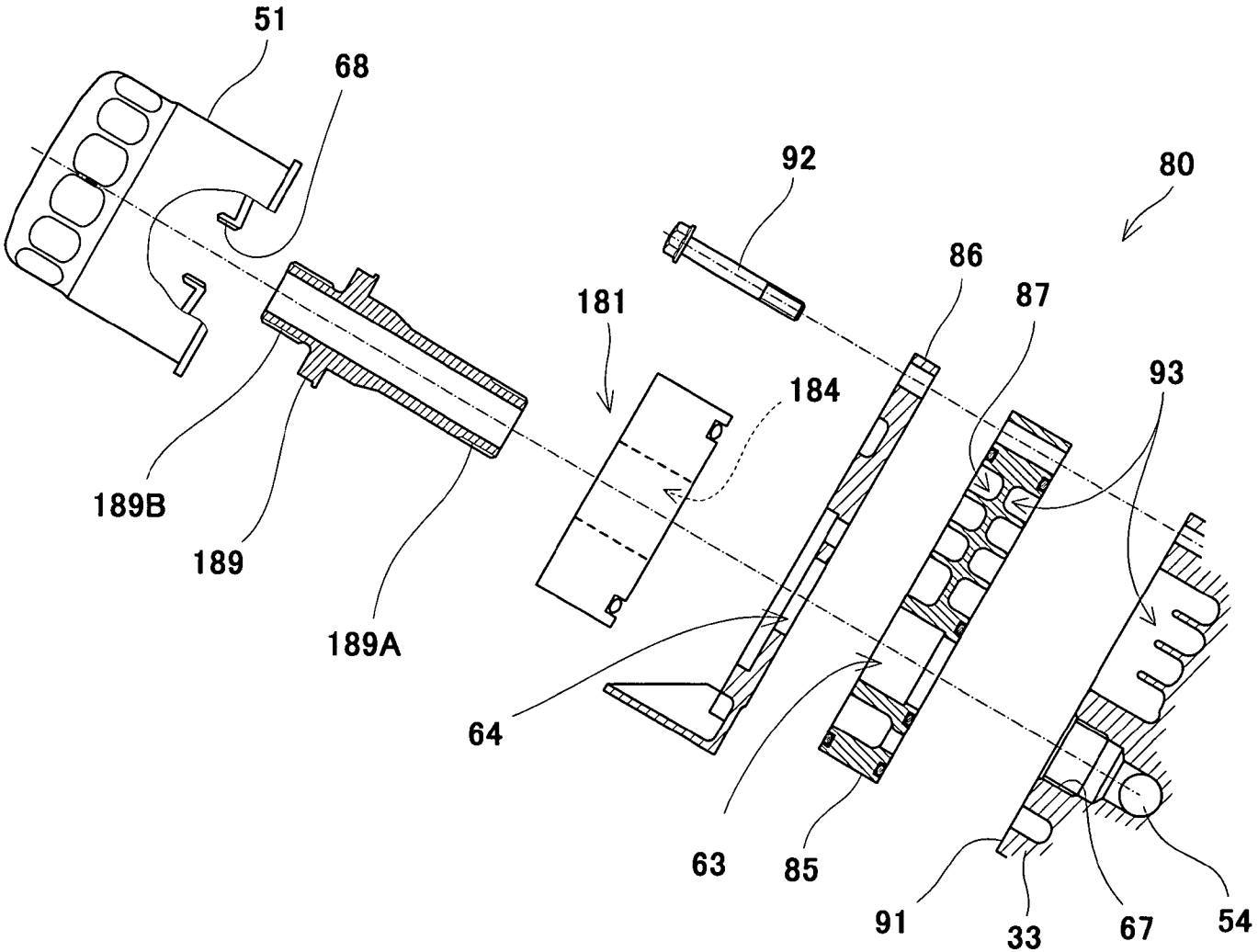
FIG. 22 is an exploded view showing the first oil cooler and the adapter in FIG. 20.

FIG. 22 shows an exploded view of the first oil cooler 80 and the adapter 181. The passage forming plate 85, the front-face cover plate 86, and the adapter 181 are arranged in successive order, and the rear-face of the passage forming plate 85 is opposed to the engine-side mounting face 91 of the crankcase 33. A tubular mounting bolt 189 having a penetrating hole along a center axis thereof is inserted through the center hole 184 of the adapter 181, the hole 64 of the front-face cover plate 86, and the hole 63 of the passage forming plate 85 and a male screw portion 189A formed on an end portion of the mounting bolt 189 is screwed to the female screw portion 67 formed on the engine-side mounting face 91. The front-face cover plate 86 and the passage forming plate 85 are fixed to the engine-side mounting face 91 by means of the screw means 92.

Further, the female screw portion 68 of the oil filter 51 is screwed to a male screw portion (portion configured to attach and detach the oil filter 51) 189B formed on an opposite end portion of the mounting bolt 189. Thereby, the first oil cooler 80, the adapter 181, and the oil filter 51 are mounted on the outer wall face of the crankcase 33 at the engine-side mounting face 91. In the oil cooler 80 described above, the mounting bolt 189 has a portion with which the adapter 181 is removably attached on the oil cooler 80. The second oil cooler 180 (see FIG. 20) is typically connected to the first oil cooler 80 through the adapter 181 and the tubes 182 and 183. It will be appreciated that the second oil cooler 180 may have a sinuous passage, multiple plate structure similar to the first oil cooler 80, or may be of a different structure suitable for cooling the oil passing therethrough. The mounting bolt 189 of this embodiment is slightly longer than the mounting bolt 66 described in the second embodiment, and the other structure may be substantially the same. The male screw portions 189A and 189B of the mounting bolt 189 have structures similar to those of the male screw portions 66A and 66B of the mounting bolt 66.

Figure 23:
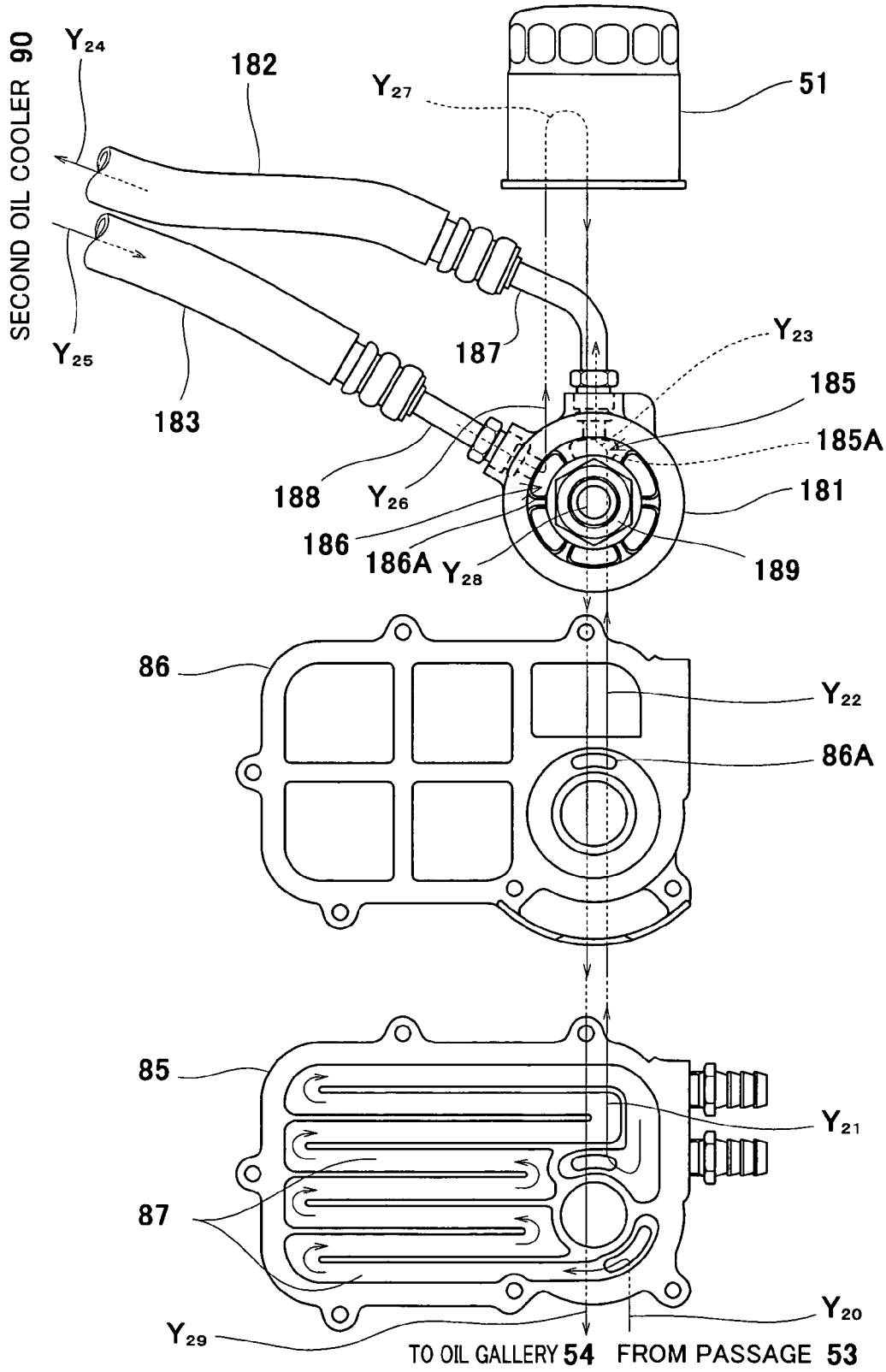
FIG. 23 is a schematic view showing flow of oil within the first oil cooler and a second oil cooler in FIG. 20.

How the oil follows within the first oil cooler 80 and the second oil cooler 180 will be described with reference to the drawings. As shown in FIG. 23, the oil flows into the first oil cooler 80 through the passage 53 formed in the wall portion of the crankcase 33 (FIG. 10). While the oil is flowing through the oil passage 87 within the first oil cooler 80 (see arrow Y20), the oil is cooled. The oil that has reached a terminal point of the oil passage 87 (see arrow Y21) flows through a penetrating hole 86A formed in the front-face cover plate 86 at a position corresponding to the terminal point (see arrow Y22) and into the first space 185 through the hole 185A of the adapter 181 (see arrow Y23). Then, the oil is delivered to the second oil cooler 180 through the joint 187 and the tube 182 (see arrow Y24).

The oil delivered to the second oil cooler 180 is cooled within the second oil cooler 180 and is returned through the tube 183 (see arrow Y25). The oil flows into the second space 186 of the adapter 181 through the joint 188 (see arrow Y26). The oil is delivered to the oil filter 51 through the hole 186A of the adapter 181 (see arrow Y27). The oil flowing within the oil filter 51 is filtered by the filter element (not shown) located inside. Thereafter, the oil flows through the inside of the mounting bolt 189 (see arrow Y28) and is delivered to the oil gallery 54 formed in the wall portion of the crankcase 33 (see arrow Y29).

As should be appreciated from the foregoing, since the first oil cooler 80 configured as described above is connected to the second oil cooler 180 through the adapter 181, this configuration may provide for proper cooling even where Engine E is a large-sized engine mounted in the personal watercraft.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An oil cooler of an engine for a small watercraft, comprising:

a first cooling portion including a passage forming plate provided with grooves respectively formed on one face thereof and an opposite face thereof, a first cover member and a second cover member stacked on the passage forming plate and configured to respectively cover the grooves, an oil passage formed by covering the groove formed on the one face of the passage forming plate with the first cover member, and a coolant passage formed by covering the groove formed on the opposite face of the passage forming plate with the second cover member;

a mounting bolt by which the first cooling portion is removably mountable on an outer wall face of the engine; and an oil filter mounted on an outer wall face of the first cover member;

wherein the first cover member is provided with a first oil hole through which the oil passage of the first cooling portion and the oil filter communicate with each other, and the second cover member is provided with a second oil hole through which the oil passage of the first cooling portion and an oil passage formed within the engine communicate with each other.

2. The oil cooler according to claim 1, wherein an oil receiving portion which is configured to receive oil that leaks out when the oil filter is removed from the first cooling portion of the oil cooler is provided on the first cover member and below the attached oil filter.

3. The oil cooler according to claim 2, wherein the oil receiving portion is plate shaped and is configured to extend from the first cover member along a center axis of the oil filter so as to surround a lower portion of the oil filter.

4. The oil cooler according to claim 1, further comprising:

an adapter configured to allow the oil passage of the first cooling portion to communicate with a second cooling portion which is configured to cool oil together with the first cooling portion;

wherein the adapter is provided between the oil filter and the first cover member.

5. The oil cooler according to claim 4, wherein the mounting bolt is tubular and is structured such that one end portion thereof protrudes outward from the first cover member to form a screw portion with which the oil filter threadedly engages, and the adapter is removably mountable to the mounting bolt between the first cover member and the oil filter.

6. The oil cooler according to claim 1, wherein the mounting bolt is tubular to have an inner passage through which the oil within the oil filter is guided to the oil passage of the engine, and is constructed such that one end portion thereof protrudes outward from the first cover member to form a first screw portion with which the oil filter threadedly engages and an opposite end portion thereof protrudes outward from the second cover member to form a second screw portion which threadedly engage with the outer wall face of the engine, and a flange portion is provided between the first screw portion and the second screw portion to thereby allow the first cooling portion to be secured to the outer wall face of the engine.

7. The oil cooler according to claim 1, wherein the first cover member is provided with a sensor attaching portion configured to attach a hydraulic pressure sensor and/or an oil temperature sensor.

8. An oil cooler of an engine for a small watercraft comprising:

a mounting portion configured to mount the oil cooler on an outer wall face of the engine;

oil passages configured to allow oil to flow therethrough; and coolant passages through which coolant for cooling the oil flows, wherein the oil cooler is capable of being disassembled such that an inside of at least the coolant passage is exposed;

a plurality of passage forming plates each provided with a groove on at least one face thereof;

wherein the passage forming plates are removably disposed to have a layered structure and are comprised of oil passage forming plates forming the oil passages and coolant passage forming plates forming the coolant passages, the oil passages and the coolant passages being alternately disposed to have a layered structure, the oil passages and the coolant passages being each formed by the groove between the passage forming plates.

9. The oil cooler according to claim 8, wherein wherein a one of the passage forming plates that is located closest to the outer wall face of the engine is removably mounted on the outer wall face of the engine with a face thereof opposed to the outer wall face of the engine in contact with the outer wall face of the engine; and wherein a part of the coolant passage is formed between the face of said one passage forming plate that is located closest to the outer wall face of the engine and the outer wall face of the engine.

10. The oil cooler according to claim 8, further comprising:

a first cooling portion including the passage forming plates which form the oil passages and coolant passages, and the passage forming plate located most distant from the outer wall face of the engine is covered with a cover member;

a mounting bolt by which the first cooling portion is mounted on the outer wall face of the engine; and an oil filter mounted on an outer wall face of the cover member;

wherein the cover member is provided with a first oil hole through which the oil passage of the first cooling portion communicates with the oil filter.

11. The oil cooler according to claim 10, further comprising:

an adapter configured to allow the oil passage of the first cooling portion to communicate with a second cooling portion configured to cool the oil together with the first cooling portion;

wherein the adapter is provided between the oil filter and the cover member on the oil passage side.

12. An oil cooler of an engine for a small watercraft, comprising:

a first cooling portion including a passage forming plate provided with a groove formed on one face thereof, a first cover member stacked on the passage forming plate and configured to cover the groove, an oil passage formed by covering the groove of the passage forming plate with the first cover member, and a coolant passage formed between an opposite face of the passage forming plate and an outer wall face of the engine which is connected with the opposite face of the passage forming plate;

a mounting bolt by which the first cooling portion is removably mountable on the outer wall face of the engine; and an oil filter mounted on the outer wall face of the first cover member;

wherein the first cover member is provided with a first oil hole through which the oil passage of the first cooling portion communicates with the oil filter.

13. The oil cooler according to claim 12, further comprising:

an adapter configured to allow the oil passage of the first cooling portion to communicate with a second cooling portion configured to cool the oil together with the first cooling portion, wherein the adapter is provided between the oil filter and the first cover member on the oil passage side.

14. The oil cooler according to claim 12, wherein the passage forming plate is provided with a groove on the opposite face thereof which is opposed to the outer wall face of the engine, and the groove formed on the face of the passage forming plate is covered with the outer wall face of the engine.

15. A small watercraft comprising:

an engine configured to drive a propulsion mechanism;

an air-intake pipe extending from a cylinder head of the engine; and an oil cooler configured to cool oil that circulates within the engine;

wherein the air-intake pipe extends from the cylinder head to a lateral side of a crankcase of the engine to have a space between the air-intake pipe and an outer wall face of the crankcase, and the oil cooler is mounted on the outer wall face within the space, wherein the oil cooler includes:

a first cooling portion including a passage forming plate provided with a groove formed on one face thereof; a first cover member stacked on the passage forming plate and configured to cover the groove; an oil passage formed by covering the groove of the passage forming plate with the first cover member; and a coolant passage formed between an opposite face of the passage forming plate and an outer wall face of a crankcase which is connected with the opposite face of the passage forming plate and configured to extend along the outer wall face of the crankcase; and a mounting bolt by which the first cooling portion is removably mountable on the outer wall face of the engine; and wherein at least part of the coolant passage is formed in the vicinity of an oil gallery which is formed within a wall portion of the crankcase of the engine to extend along the outer wall face of the crankcase to thereby allow the oil to flow therethrough.

16. The small watercraft according to claim 15, wherein a groove is formed on the outer wall face of the crankcase that partially forms the coolant passage.

17. The small watercraft according to claim 15, being a personal watercraft comprising a water jet pump driven by the engine.

18. The small watercraft according to claim 15, wherein the first cover member is provided with a sensor attaching portion configured to attach a hydraulic pressure sensor and/or an oil temperature sensor.

* * * * *